US011514855B2

(12) United States Patent
Lim et al.

(10) Patent No.: US 11,514,855 B2
(45) Date of Patent: Nov. 29, 2022

(54) DISPLAY DEVICE

(71) Applicant: Samsung Display Co., Ltd., Yongin-Si (KR)

(72) Inventors: Jaekeun Lim, Suwon-si (KR); Hongsoo Kim, Hwaseong-si (KR); Jinyoung Roh, Hwaseong-si (KR); Sehyuk Park, Seongnam-si (KR); Hyojin Lee, Seongnam-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/219,729

(22) Filed: Mar. 31, 2021

(65) Prior Publication Data

US 2022/0020328 A1 Jan. 20, 2022

(30) Foreign Application Priority Data

Jul. 14, 2020 (KR) ..... 10-2020-0086866

(51) Int. Cl.
*G09G 3/3258* (2016.01)

(52) U.S. Cl.
CPC ... *G09G 3/3258* (2013.01); *G09G 2300/0413* (2013.01); *G09G 2300/0426* (2013.01); *G09G 2300/0809* (2013.01); *G09G 2320/0238* (2013.01); *G09G 2330/028* (2013.01)

(58) Field of Classification Search
CPC ..... G09G 3/3233; G09G 3/3258; G09G 2300/0413; G09G 2300/0809–0871; G09G 3/32–3291; G09G 2320/043; G09G 2300/0861; G09G 2320/0214; G09G 2310/08; G09G 2300/0426; G09G 2300/0819; G09G 2300/0842; G09G 2310/0202; G09G 2310/0251; G09G 2310/0262; G09G 2320/0238; G09G 2320/04–048; G09G 2330/028; H01L 27/3223
USPC ..... 345/76–83
See application file for complete search history.

(56) References Cited

U.S. PATENT DOCUMENTS

| | | | |
|---|---|---|---|
| 8,803,770 | B2 | 8/2014 | Jeong et al. |
| 8,817,008 | B2 | 8/2014 | Park et al. |
| 10,700,146 | B2 | 6/2020 | Chai et al. |
| 10,810,938 | B2 | 10/2020 | Lee et al. |

(Continued)

FOREIGN PATENT DOCUMENTS

| | | | |
|---|---|---|---|
| KR | 10-1040786 | B1 | 6/2011 |
| KR | 10-1152466 | B1 | 6/2012 |

(Continued)

*Primary Examiner* — Amr A Awad
*Assistant Examiner* — Aaron Midkiff
(74) *Attorney, Agent, or Firm* — Innovation Counsel LLP

(57) ABSTRACT

A display device includes a pixel, wherein the pixel includes a light emitting element, a first transistor connected to a first power line and the light emitting element and controlled by a voltage of a first node, a second transistor connected to a data line and the first transistor and controlled by an i-th scan signal, a third-first transistor connected to the first transistor and a second node and controlled by a first control signal, a third transistor connected to the second node and the first node and controlled by a second control signal, and a dummy transistor including a first electrode receiving a reference voltage, a second electrode connected to the second node, and a control electrode connected to an emission line.

20 Claims, 17 Drawing Sheets

(56) References Cited

U.S. PATENT DOCUMENTS

| | | | | |
|---|---|---|---|---|
| 2009/0201231 | A1* | 8/2009 | Takahara | G09G 3/3233 345/76 |
| 2011/0157144 | A1* | 6/2011 | Park | G09G 3/3233 345/212 |
| 2019/0147799 | A1* | 5/2019 | Kim | G09G 3/3291 345/55 |
| 2019/0287464 | A1 | 9/2019 | Park et al. | |
| 2019/0371237 | A1* | 12/2019 | Qian | G09G 3/3233 |

FOREIGN PATENT DOCUMENTS

| | | | |
|---|---|---|---|
| KR | 10-1794648 | B1 | 11/2017 |
| KR | 10-2018-0067768 | A | 6/2018 |
| KR | 10-2019-0069208 | A | 6/2019 |
| KR | 10-2019-0100565 | A | 8/2019 |
| KR | 10-2019-0109673 | A | 9/2019 |

* cited by examiner

DISPLAY DEVICE

CROSS-REFERENCE TO RELATED APPLICATIONS

This U.S. non-provisional patent application claims priority under 35 U.S.C. § 119 of Korean Patent Application No. 10-2020-0086866, filed on Jul. 14, 2020, the disclosure of which is incorporated by reference in its entirety.

BACKGROUND

The present disclosure herein relates to a display device capable of reducing a leakage current.

In general, an electronic apparatus such as a smartphone, a digital camera, a notebook computer, a navigation device, or a smart television includes a display device for displaying an image. The display device generates an image, and a user views the generated image through a display screen of the display device.

The display device includes a plurality of pixels for generating the image and a driver for driving the pixels. Each of the pixels may include a light emitting element, one or more transistors connected to the light emitting element, and at least one capacitor connected to the transistors.

A leakage current may be generated by a parasitic capacitor influencing to drive the light emitting element. Accordingly, the leakage current may degrade the display quality of the display device.

SUMMARY

The present disclosure provides a display device capable of reducing a leakage current.

According to an embodiment of the inventive concept, a display device includes a pixel, wherein the pixel includes: a light emitting element; a first transistor including a first electrode connected to a first power line, a second electrode connected to the light emitting element, and a control electrode connected to a first node; a second transistor including a first electrode connected to a data line, a second electrode connected to the first electrode of the first transistor, and a control electrode connected to an i-th scan line; a third-first transistor including a first electrode connected to the second electrode of the first transistor, a second electrode connected to a second node, and a control electrode receiving a first control signal; a third transistor including a first electrode connected to the second node, a second electrode connected to the first node, and a control electrode receiving a second control signal; and a dummy transistor including a first electrode receiving a reference voltage, a second electrode connected to the second node, and a control electrode connected to an emission line.

The reference voltage may be set to an average voltage value of data voltages provided to a plurality of pixels.

The reference voltage may correspond to a value obtained by subtracting a threshold voltage of the first transistor from a data voltage applied to the data line.

The reference voltage may be set to a data voltage applied to the data line.

A second magnitude of the second control signal that corresponds to a second difference between a second high level of the second control signal and a second low level of the second control signal may be less than a first magnitude of the first control signal that corresponds to a first difference between a first high level of the first control signal and a first low level of the first control signal.

A second magnitude of the second control signal that corresponds to a second difference between a second high level of the second control signal and a second low level of the second control signal may be less than a first magnitude of an emission signal applied to the emission line and a third magnitude of an i-th scan signal applied to the i-th scan line. The first magnitude of the emission signal may correspond to a first difference between a first high level of the emission signal and a first low level of the emission signal, and the third magnitude of the i-th scan signal may correspond to a third difference between a third high level of the i-th scan signal and a third low level of the i-th scan signal.

The first control signal and the second control signal may have a same timing as an i-th scan signal applied to the i-th scan line.

The pixel may further include: a fourth transistor comprising a first electrode connected to the first node, a second electrode receiving an initialization voltage, and a control electrode connected to an (i−1)-th scan line; a fifth transistor comprising a first electrode connected to the first power line, a second electrode connected to the first electrode of the first transistor, and a control electrode connected to the emission line; and a sixth transistor comprising a first electrode connected to the second electrode of the first transistor, a second electrode connected to the light emitting element, and a control electrode connected to the emission line.

The first control signal may be same as the second control signal.

The pixel may further include: a fourth transistor comprising a first electrode connected to the second node, a second electrode receiving an initialization voltage, and a control electrode connected to an (i−1)-th scan line; a fifth transistor comprising a first electrode connected to the first power line, a second electrode connected to the first electrode of the first transistor, and a control electrode connected to the emission line; and a sixth transistor comprising a first electrode connected to the second electrode of the first transistor, a second electrode connected to the light emitting element, and a control electrode connected to the emission line.

The first control signal may be an i-th scan signal applied to the i-th scan line.

The first control signal may be same as the second control signal.

A first activation period of the second control signal may be longer than a second activation period of an (i−1)-th scan line applied to the (i−1)-th scan line and a third activation period of an i-th scan signal applied to the i-th scan line. The third activation period of the i-th scan signal and the second activation period of the (i−1)-th scan signal may be disposed within the first activation period of the second control signal.

According to another embodiment of the inventive concept, a display device includes a pixel, wherein the pixel includes: a light emitting element; a first transistor including a first electrode connected to a first power line, a second electrode connected to the light emitting element, and a control electrode connected to a first node; a second transistor including a first electrode connected to a data line, a second electrode connected to the first electrode of the first transistor, and a control electrode connected to an i-th scan line; a third-first transistor including a first electrode connected to the second electrode of the first transistor, a second electrode connected to a second node, and a control electrode receiving a control signal; a third transistor including a first electrode connected to the second node, a second electrode connected to the first node, and a control electrode receiving the control signal; and a dummy capacitor including a first electrode receiving a reference voltage, and a second electrode connected to the second node.

The pixel may further include: a fourth transistor comprising a first electrode connected to the second node, a second electrode receiving an initialization voltage, and a control electrode connected to an (i−1)-th scan line; a fifth transistor comprising a first electrode connected to the first power line, a second electrode connected to the first electrode of the first transistor, and a control electrode connected to an emission line; and a sixth transistor comprising a first electrode connected to the second electrode of the first transistor, a second electrode connected to the light emitting element, and a control electrode connected to the emission line.

A first activation period of the control signal may be longer than a second activation period of an (i−1)-th scan signal applied to the (i−1)-th scan line and a third activation period of an i-th scan signal applied to the (i−1)-th scan line. The third activation period of the i-th scan signal and the second activation period of the (i−1)-th scan signal may be disposed within the first activation period of the control signal.

The control signal may include: a first control signal applied to the control electrode of the third-first transistor; and a second control signal applied to the control electrode of the third transistor. A second magnitude of the second control signal that corresponds to a second difference between a second high level of the second control signal and a second low level of the second control signal may be less than a first magnitude of the first control signal that corresponds to a first difference between a first high level of the first control signal and a first low level of the first control signal.

The pixel may further include: a first connection electrode disposed on the sixth transistor and connected to the sixth transistor; a second connection electrode disposed on the first connection electrode and connected to the first connection electrode and the light emitting element; and a dummy electrode disposed in an upper layer than the first transistor.

The first electrode of the dummy capacitor may be formed of a same material as an active area of the first transistor and disposed in a same layer as the active area of the first transistor. The second electrode of the dummy capacitor may be formed of a same material as one among the dummy electrode, the first connection electrode, and the second connection electrode and disposed in a same layer as the one among the dummy electrode, the first connection electrode, and the second connection electrode.

The first electrode of the dummy capacitor may be formed of a same material as the control electrode of the first transistor and disposed in a same layer as the control electrode of the first transistor. The second electrode of the dummy capacitor may be formed of a same material as one of the dummy electrode, the first connection electrode, or the second connection electrode and disposed in a same layer as the one of the dummy electrode, the first connection electrode, or the second connection electrode.

BRIEF DESCRIPTION OF THE FIGURES

The accompanying drawings are intended to provide further understanding of the inventive concept, and are incorporated in and constitute a part of the present disclosure. The drawings illustrate embodiments of the inventive concept and, together with the description, serve to explain principles of the inventive concept. In the drawings.

DETAILED DESCRIPTION

Figure 1:
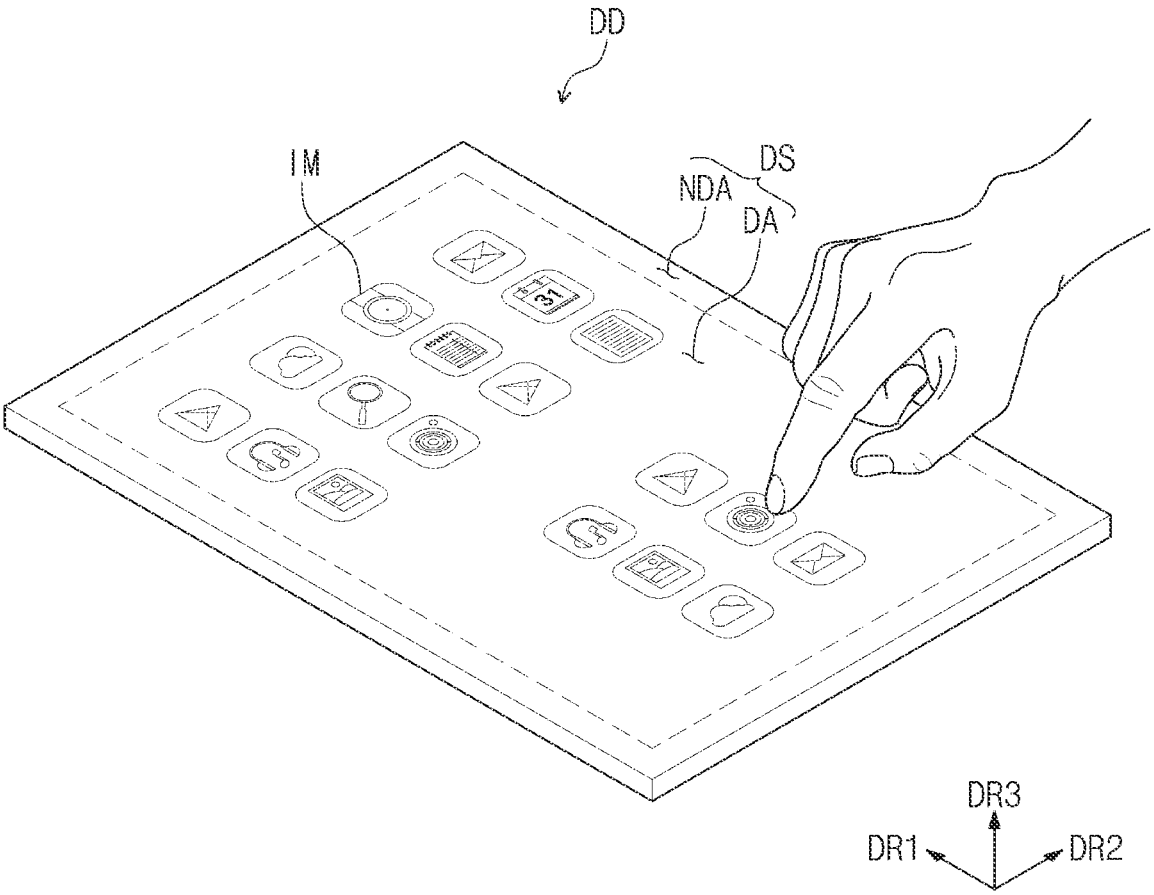
FIG. 1 is a perspective view of a display device according to an embodiment of the inventive concept.

It will be understood that when an element or layer is referred to as being "on," "connected to," or "coupled to" another element or layer, it can be directly on, connected or coupled to the other element, or one or more intervening elements or layers may be present therebetween.

Like reference numerals in the drawings refer to like elements. In addition, in the drawings, the thickness, the ratio, and the dimension of the elements are exaggerated for effective description and technical explanation.

The term "and/or" includes any and all combinations of one or more of the associated items.

Terms such as first, second, and the like may be used to describe various components, elements, regions, layers, and/or sections, but these components, elements, regions, layers, and/or sections should not be limited by the terms. These terms are only used to distinguish one component, element, region, layer, and/or section from another component, element, region, layer, and/or section. For instance, a first component may be referred to as a second component, or similarly, a second component may be referred to as a first component, without departing from the scope of the present disclosure. As used herein, singular forms such as "a," "an," and "the" may be intended to include plural forms as well, unless the context clearly indicates otherwise.

In addition, the spatially relative terms such as "under," "lower," "on," and "upper" are used for explaining associations of items as illustrated in the drawings. It will be understood that the spatially relative terms are intended to encompass different orientations of the device in use or operation in addition to the orientation depicted in the figures.

Unless otherwise defined, terms (including technical and scientific terms) used herein have the same meaning as commonly understood by one of ordinary skill in the art to which the present disclosure belongs. In addition, it will be further understood that terms, such as those defined in commonly-used dictionaries, should be interpreted as having a meaning that is consistent with their meaning in the context of the relevant art and will not be interpreted in an idealized or overly formal sense unless expressly so defined herein.

It will be further understood that the terms "includes" and/or "including," when used in the present disclosure, specify the presence of stated features, integers, steps, operations, elements, components, or combinations thereof, but do not preclude the presence or addition of one or more other features, integers, steps, operations, elements, components, or combinations thereof.

Hereinafter, embodiments of the present disclosure will be described in detail with reference to the accompanying drawings.

FIG. 1 is a perspective view of a display device according to an embodiment of the inventive concept.

Referring to FIG. 1, a display device DD may have a rectangular shape including long sides extending in a first direction DR1 and short sides extending in a second direction DR2 that intersects with the first direction DR1. However, the display device DD is not limited hereto and may have various other shapes such as a circular shape and a polygonal shape.

Hereinafter, a direction that substantially vertically crosses and normal to the plane defined by the first and second directions DR1 and DR2 is referred to as a third direction DR3. In addition, in the present disclosure, the expression "when viewed in a plan view" refers to a state viewed in the third direction DR3.

The top surface of the display device DD may also be referred to as a display surface DS that extends in the first direction DR1 and the second direction DR2. Images IM generated in the display device DD may be provided to the user through the display surface DS of the display device DD.

The display surface DS may include a display area DA and a non-display area NDA that surrounds the display area DA. An image IM may be displayed in the display area DA, but the image IM may not be displayed in the non-display area NDA. The non-display area NDA may define a boundary of the display device DD. The boundary of the display device DD may have a prescribed color.

The display device DD may be used in a large electronic device such as a television, a monitor, and an outdoor billboard. In addition, the display device ED may be a small or medium-sized electronic device such as a personal computer (PC), a notebook computer, a personal digital assistant (PDA), a vehicle navigator, a game console, a smartphone, a tablet, or a camera, etc. However, these are only presented as embodiments of the present disclosure and may be adopted in other electronic devices without deviating from the present disclosure.

Figure 2:
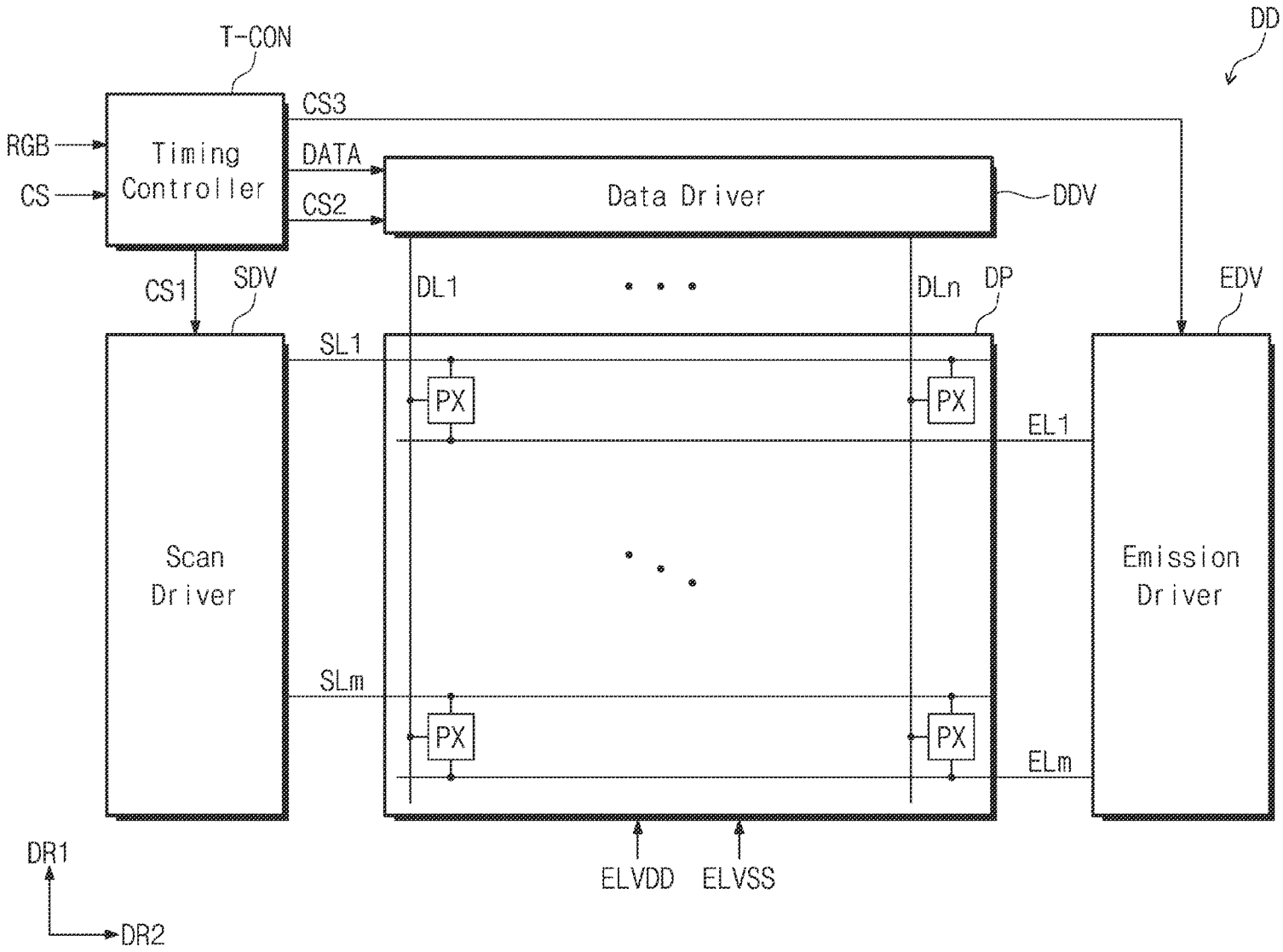
FIG. 2 is a block diagram of the display device shown in FIG. 1.

FIG. 2 is a block diagram of the display device DD shown in FIG. 1.

Referring to FIG. 2, the display device DD may include a display panel DP, a scan driver SDV, a data driver DDV, an emission driver EDV, and a timing controller T-CON. The display panel DP may include a plurality of pixels PX, a plurality of scan lines SL1 to SLm, a plurality of data lines DL1 to DLn, and a plurality of emission lines EL1 to ELm. Here, m and n are natural numbers.

The scan lines SL1 to SLm may extend in the second direction DR2 and connect the pixels PX and the scan driver SDV. The data lines DL1 to DLn may extend in the first direction DR1 and connect the pixels PX and the data driver DDV. The emission lines EL1 to ELm may extend in the second direction DR2 and connect the pixels PX and the emission driver EDV.

A first voltage ELVDD and a second voltage ELVSS may be applied to the display panel DP. The second voltage ELVSS may have a voltage level lower than that of the first voltage ELVDD. The first voltage ELVDD and the second voltage ELVSS may be applied to the pixels PX. The display device DD may further include a voltage generator (not shown) for generating the first voltage ELVDD and the second voltage ELVSS.

The timing controller T-CON may receive image signals RGB and a control signal CS from the outside (e.g., a system board). The timing controller T-CON may convert a data format of the image signals RGB to another data format compatible with the interface specification of the data driver DDV and generate image data. The timing controller T-CON may provide the image data to the data driver DDV.

In response to the control signal CS provided from the outside, the timing controller T-CON may generate and output a first control signal CS1, a second control signal CS2, and a third control signal CS3. The first control signal CS1 may include a scan control signal, the second control signal CS2 may include a data control signal, and the third control signal CS3 may include an emission control signal. The first control signal CS1 may be provided to the scan driver SDV, the second control signal CS2 may be provided to the data driver DDV, and the third control signal CS3 may be provided to the emission driver EDV.

The scan driver SDV may generate a plurality of scan signals in response to the first control signal CS1. The scan signals may be applied to the pixels PX through the scan lines SL1 to SLm. The data driver DDV may generate a plurality of data voltages corresponding to the image data DATA in response to the second control signal CS2. The data voltages may be applied to the pixels PX through the data lines DL1 to DLn. The emission driver EDV may generate a plurality of emission signals in response to the third control signal CS3. The emission signals may be applied to the pixels PX through the emission lines EL1 to ELm.

The pixels PX may receive the data voltages in response to the scan signals. The pixels PX may display an image by emitting light of the brightness corresponding to the data voltages in response to the emission signals. An emission time of the pixels PX may be controlled by the emission signals.

Figure 3:
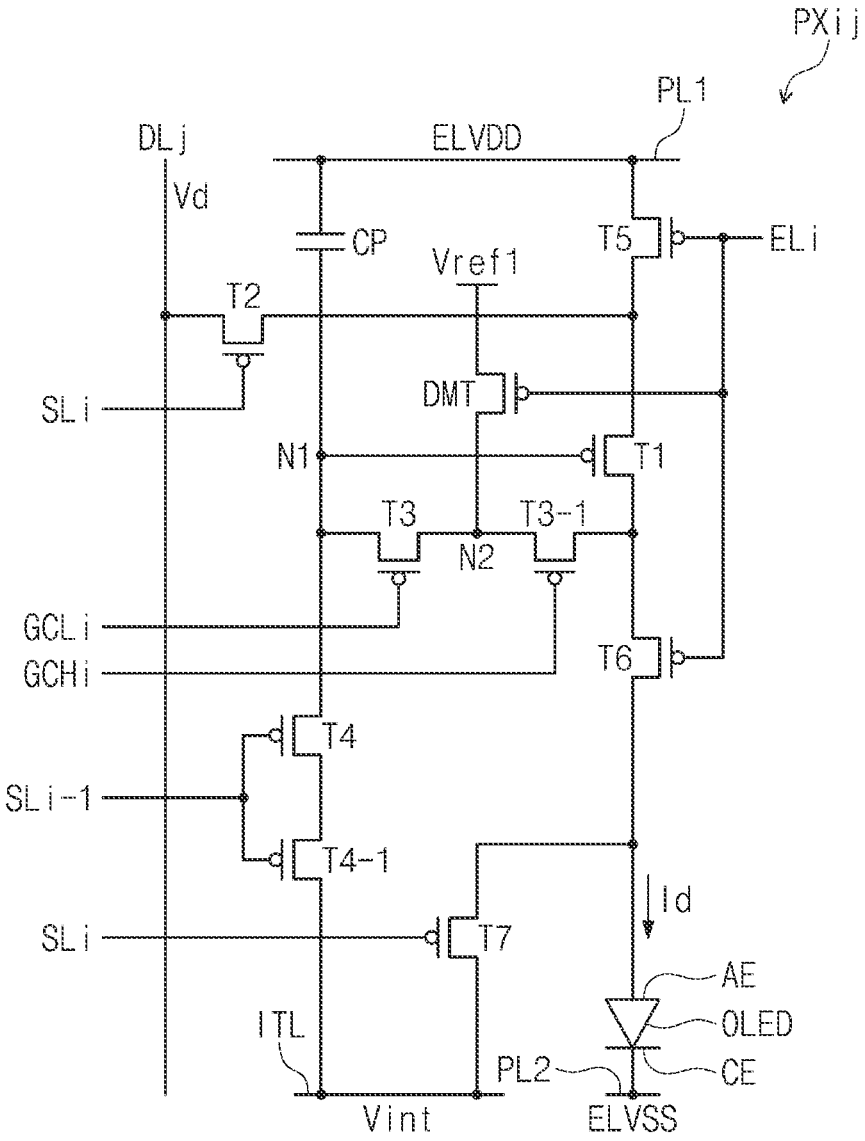
FIG. 3 illustrates an equivalent circuit of a pixel shown in FIG. 2.
Figure 4:
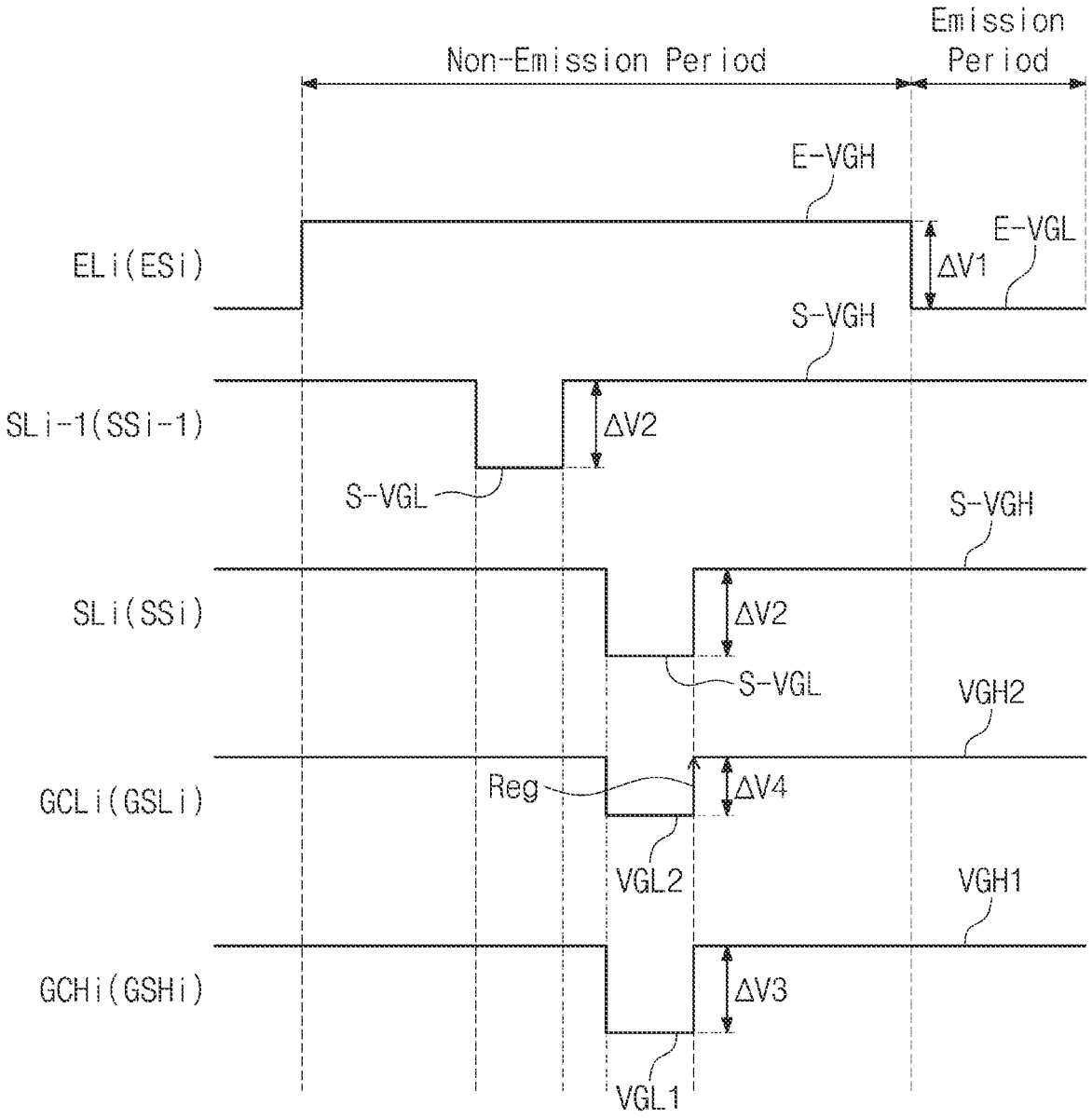
FIG. 4 is a timing diagram of signals for driving the pixel illustrated in FIG. 3.

FIG. 3 illustrates an equivalent circuit of a pixel PX shown in FIG. 2. FIG. 4 is a timing diagram of signals for driving the pixel PX illustrated in FIG. 3.

In FIG. 3, the pixel PX also referred to as PXij connected to an i-th scan line SLi, an i-th emission line EL1, and a j-th data line DLj is exemplarily illustrated. Here, i and j are natural numbers.

Referring to FIG. 3, the pixel PXij may include a light emitting element OLED, a plurality of transistors including T1, T2, T3, T3-1, T4, T4-1, T5, T6, T7, and DMT, and a capacitor CP. The transistors and the capacitor CP may control an amount of current flowing through the light emitting element OLED in correspondence to a data voltage Vd received through the data line DLj. The light emitting element OLED may generate light having prescribed brightness corresponding to the amount of current.

Each of the transistors may include an input electrode (or a source electrode), an output electrode (or a drain electrode), and a control electrode (or a gate electrode). For convenience in the present disclosure, any one of the input electrode and the output electrode is referred to as a first electrode, and the other is referred to as a second electrode.

A first transistor T1 may be referred to as a driving transistor, and a second transistor T2 may be referred to as a switching transistor. A third transistor T3 and a third-first transistor T3-1 may be collectively referred to as a compensation transistor.

A fourth transistor T4 and a fourth-first transistor T4-1 may be collectively referred to as a first initialization transistor, and a seventh transistor T7 may be referred to as a second initialization transistor. A fifth transistor T5 may be referred to as an emission control transistor.

According to one embodiment, the light emitting element OLED may be an organic light emitting element. The light emitting element OLED may include an anode AE and a cathode CE. The anode AE may be connected to a first power line PL1 through the sixth, first, and fifth transistors T6, T1, and T5. The cathode CE may be connected to a second power line PL2. The first voltage ELVDD may be applied to the first power line PL1, and the second voltage ELVSS may be applied to the second power line PL2. The first and second power lines PL1 and PL2 may be arranged in the display panel DP.

The first transistor T1 may be connected between the fifth electrode T5 and the sixth transistor T6. The first transistor T1 may include a first electrode connected to the first power line PL1 through the fifth transistor T5, a second electrode connected to the anode AE of the light emitting element OLED through the sixth transistor T6, and a control electrode connected to a first node N1.

The first electrode of the first transistor T1 may receive the first voltage ELVDD through the fifth transistor T5. The first transistor T1 may control an amount of current flowing through the organic light emitting element OLED according to a voltage applied to the control electrode of the first transistor T1.

The second transistor T2 may be connected between the data line DLj and the first electrode of the first transistor T1. The second transistor T2 may include a first electrode connected to the data line DLj, a second electrode connected to the first electrode of the first transistor T1, and a control electrode connected to the i-th scan line SLi.

The second transistor T2 may be turned on by an i-th scan signal received through the i-th scan line SLi and electrically connect the data line DLj and the first electrode of the first transistor T1. The second transistor T2 may perform a switching operation for providing the data voltage Vd received through the data line DLj to the first electrode of the first transistor T1.

The third transistor T3 and the third-first transistor T3-1 (collectively referred to as the compensation transistor) may be connected between the second electrode of the first transistor T1 and the first node N1. The third-first transistor T3-1 may include a first electrode connected to the second electrode of the first transistor T1, a second electrode connected to a second node N2, and a control electrode connected to an i-th first control line GCHi. The control electrode of the third-first transistor T3-1 may receive an i-th first control signal through the i-th first control line GCHi.

The third transistor T3 may include a first electrode connected to the second node N2, a second electrode connected to the first node N1, and a control electrode connected to an i-th second control line GCLi. The third transistor T3 may receive an i-th second control signal through the i-th second control line GCLi.

The third-first transistor T3-1 and the third transistor T3 may be respectively turned on in response to the i-th first and second control signals and electrically connect the second electrode of the first transistor T1 and the control electrode of the first transistor T1. When the third-first transistor T3-1 and the third transistor T3 are turned on, the first transistor T1 may be diode-connected through the third-first transistor T3-1 and the third transistor T3 that are turned on.

Although not shown in FIG. 3, the i-th first control line GCHi and the i-th second control line GCLi may be connected to the emission driver EDV. The emission driver EDV may generate the i-th first control signal and the i-th second control signal and apply them to the third-first transistor T3-1 and the third transistor T3 through the i-th first control line GCHi and the i-th second control lint GCLi, respectively.

The compensation transistor designed as a dual-gate structure including the two transistors T3 and T3-1 may suppress a leakage current upon being turned off. In the dual gate structure, the two gate electrodes (the two control electrodes) may be connected to each other having the same potential, and the channel length thereof may be elongated in comparison to a single gate structure. An elongated channel length of the compensation transistor may increase the resistance and, upon being turned off, the leakage current may be reduced to secure the stability of an operation.

The fourth transistor T4 and the fourth-first transistor T4-1 (collectively referred to as the first initialization transistor) may be connected between the first node N1 and an initialization line ITL. The fourth transistor T4 may include a first electrode connected to the first node N1, a second electrode connected to the initialization line ITL through the fourth-first transistor T4-1, and a control electrode connected to an (i−1)-th scan line SLi−1. The fourth-first transistor T4-1 may include a first electrode connected to the second electrode of the fourth transistor T4, a second electrode connected to the initialization line ITL, and a control electrode connected to the (i−1)-th scan line SLi−1. The initialization line ITL may be arranged in the display panel DP.

An initialization voltage Vint may be applied to the initialization line ITL. The voltage generator may generate the initialization voltage Vint. The fourth transistor T4 and the fourth-first transistor T4-1 may be turned on by the (i−1)-th scan signal received through the (i−1)-th scan line SLi−1 and provide the initialization voltage Vint to the first node N1. The first initialization transistor designed as a dual-gate structure including the two transistors T4 and T4-1 may suppress a leakage current upon being turned off.

The fifth transistor T5 may be connected between the first power line PL1 and the first transistor T1. The fifth transistor T5 may include a first electrode connected to the first power line PL1, a second electrode connected to the first electrode of the first transistor T1, and a control electrode connected to the i-th emission line EL1.

The sixth transistor T6 may be connected between the first electrode T1 and the light emitting element OLED. The sixth transistor T6 may include a first electrode connected to the second electrode of the first transistor T1, a second electrode connected to the anode AE of the light emitting element OLED, and a control electrode connected to the i-th emission line EL1.

The fifth transistor T5 and the sixth transistor T6 may be turned on by an i-th emission signal ESi received through the i-th emission line EL1. The first voltage ELVDD may be provided to the light emitting element OLED by the fifth transistor T5 and sixth transistor T6 that are turn on, and the driving current may flow through the light emitting element OLED. The light emitting element OLED may emit light according to the driving current.

The seventh transistor T7 also referred to as the second initialization transistor may be connected between the initialization line ITL and the anode AE of the light emitting element OLED. The seventh transistor T7 may include a first electrode connected to the anode AE of the light emitting element OLED, a second electrode connected to the initialization line ITL, and a control electrode connected to the i-th scan line SLi. However, the embodiment of the present disclosure is not limited thereto, and the control electrode of the seventh transistor T7 may be connected to the (i−1)-th scan line SLi−1 or an (i+1)-th scan line SLi+1.

The seventh transistor T7 may be turned on by the i-th scan signal received through the i-th scan line SLi and provide the initialization voltage Vint to the anode AE of the light emitting element OLED. In another embodiment, the seventh transistor T7 may be omitted.

The seventh transistor T7 may improve black level representation capability of the pixel PX. When the seventh transistor T7 is turned on, a parasitic capacitor (not shown) of the organic light emitting element OLED may be discharged. Accordingly, the organic light emitting element OLED may properly implement black luminance without emitting light due to a leakage current from the first transistor T1, and thereby the black level representation capability may be improved.

The capacitor CP may be connected between the first power line PL1 and the first node N1. The capacitor CP may include a first electrode connected to the first power line PL1 and a second electrode connected to the first node N1. When the fifth transistor T5 and the sixth transistor T6 are turned on, the current may flow through the first transistor T1 according to the voltage stored in the capacitor CP at the first node N1. The current flowing through the first transistor T1 may be determined by the data voltage Vd received through the data line DLj.

A dummy transistor DMT may include a first electrode for receiving a reference voltage Vref1, a second electrode connected to the second node N2, and a control electrode connected to the i-th emission line EL1. The voltage generator may generate the reference voltage Vref1 having a direct current (DC) voltage.

In FIG. 3, the transistors are illustrated on the basis of a positive channel metal oxide semiconductor (PMOS), but the embodiment of the inventive concept is not limited thereto. The transistors in another embodiment of the inventive concept may be formed on the basis of a negative channel metal oxide semiconductor (NMOS).

Hereinafter, an operation of the pixel PXij will be described in detail with reference to the timing diagram in FIG. 4, and each signal of a low level is referred to as an activated signal.

Referring to FIGS. 3 and 4, the i-th emission signal ESi applied to the pixel PXij through the i-th emission line EL1 may have a high level E-VGH and a low level E-VGL that is lower than the high level E-VGH. A period in which the i-th emission signal ESi has the low level E-VGL may be referred to as an emission period or an activation period of the i-th emission signal ESi. A period in which the i-th emission signal ESi has the high level E-VGH may be referred to as a non-emission period or a non-activation period of the i-th emission signal ESi.

The difference between the high level E-VGH and the low level E-VGL may be referred to as a first magnitude ΔV1. The first magnitude ΔV1 may also be referred to as the magnitude of the i-th emission signal ESi.

An (i−1)-th scan signal SSi−1 and an i-th scan signal SSi applied to the pixel PXij through the (i−1)-th scan line SLi−1 and the i-th scan line SLi may respectively have a high level S-VGH and a low level S-VGL that is lower than the high level S-VGH. A period in which the (i−1)-th scan signal SSi−1 and the i-th scan signal SSi have the low level E-VGL may be referred to as an activation period or an activation period of the i-th scan signal SSi.

The difference between the high level S-VGH and the low level S-VGL may be referred to as a second magnitude ΔV2. The second magnitude ΔV2 may also be referred to as the magnitude of the (i−1)-th scan signal and the magnitude of the i-th scan signal SSi.

An i-th first control signal GSHi applied to the pixel PXij through the i-th first control line GCHi may have a first high level VGH1 and a first low level VGL1 that is lower than the first high level VGH1. A period in which the i-th first control signal GSHi has the first low level VGL1 may be referred to as an activation period of the i-th first control signal GSHi.

The difference between the first high level VGH1 and the first low level VGL1 may be referred to as a third magnitude ΔV3. The third magnitude ΔV3 may also be referred to as the magnitude of the i-th first control signal GSHi.

An i-th second control signal GSLi applied to the pixel PXij through an i-th second control line GCLi may have a second high level VGH2 and a second low level VGL2 that is lower than the second high level VGH2. A period in which the i-th second control signal GSLi has the second low level VGL2 may be referred to as an activation period of the i-th second control signal GSLi.

The difference between the second high level VGH2 and the second low level VGL2 may be referred to as a fourth magnitude ΔV4. The fourth magnitude ΔV4 may also be referred to as the magnitude of the i-th second control signal GSLi.

According to one embodiment, the fourth interval ΔV4 may be less than the third interval ΔV3. In addition, the fourth magnitude ΔV4 may be less than the first magnitude ΔV1 and the second magnitude ΔV2. The third magnitude ΔV3 may be the same as the first magnitude ΔV1 or the second magnitude ΔV2.

After the (i−1)-th scan signal SSi−1 is activated, the i-th scan signal SSi may be activated. The i-th first control signal GSHi and the i-th second control signal GSLi may have the same activation timing as the i-th scan signal SSi. For example, the activation period of the i-th first control signal GSHi and the activation period of the i-th second control signal GSLi may overlap the activation period of the i-th scan signal SSi.

The activated i-th scan signal SSi, (i−1)-th scan signal SSi−1, i-th first control signal GSHi, and i-th second control signal GSLi may be applied to the pixel PXij during the non-emission period. Hereinafter, an operation in which each signal is applied to a corresponding transistor may indicate an operation in which the corresponding activated signal is applied to the transistor.

The (i−1)-th scan signal SSi−1 may be applied to turn on the first initialization transistor, i.e., the fourth and fourth-first transistors T4 and T4-1. The initialization voltage Vint may be applied to the first node N1 through the fourth and fourth-first transistors T4 and T4-1. Accordingly, the initialization voltage Vint may be applied to the control electrode of the first transistor T1, and the first transistor T1 may be initialized by the initialization voltage Vint.

Then, the i-th scan signal SSi may be applied to the second transistor T2 to turn on the second transistor T2. In addition, the i-th first control signal GSHi and the i-th second control signal GSLi may be respectively applied to turn on the third-first transistor T3-1 and the third transistor T3.

Accordingly, the first transistor T1 may be diode-connected through the third-first transistor T3-1 and the third transistor T3 that are turned on. In this case, a compensation voltage Vd−Vth, which is obtained by subtracting a threshold voltage Vth of the first transistor T1 from the data voltage Vd supplied through the data line DLj, may be applied to the control electrode of the first transistor T1.

The first voltage ELVDD and the compensation voltage Vd−Vth may be respectively applied to the first electrode and the second electrode of the capacitor CP. Charges corresponding to a voltage difference between the first electrode and the second electrode may be stored in the capacitor CP.

Then, during the emission period, the i-th emission signal ESi may be applied to the fifth transistor T5 and the sixth transistor T6 through the i-th emission line Eli, and the fifth transistor T5 and the sixth transistor T6 may be turned on. In this case, a driving current Id may be generated that corresponds to the difference between the first voltage ELVDD and a voltage of the control electrode of the first transistor T1. The driving voltage Id may be provided to the light emitting element OLED through the sixth transistor T6.

During the emission period, a gate-source voltage Vgs of the first transistor T1 may correspond to the difference between the first voltage ELVDD and the compensation voltage Vd−Vth, the difference being expressed as the following Equation (1).

$$Vgs = ELVDD - (Vd - Vth) \quad (1)$$

A relationship between the current and voltage of the first transistor T1 may be expressed as the following Equation (2). Equation (2) represents a relationship between current and voltage of a typical transistor.

$$Id = (1/2)\mu Cox(W/L)(Vgs - Vth)^2 \quad (2)$$

When Equation (1) is substituted to Equation (2), the threshold voltage Vth is removed, and the driving current Id may be proportional to a square value $(ELVDD-Vd)^2$ of a value obtained by subtracting the data voltage Vd from the first voltage ELVDD. Accordingly, the driving current Id may be determined regardless of the threshold voltage Vth of the first transistor T1. Such an operation may be referred to as a threshold voltage compensation operation.

In the non-emission period, a voltage of the second node N2 may vary according to the i-th second control signal GSLi. The third transistor T3 may have a parasitic capacitor. When the i-th second control signal GSLi is applied to the third transistor T3, a voltage level of the second node N2 may vary due to the parasitic capacitor of the third transistor T3 at a rising edge Reg of the i-th second control signal GSLi. Such a phenomenon may be referred to as a coupling phenomenon of a capacitor. The rising edge Reg may indicate a time point at which a signal varies from a low level to a high level.

The leakage current in a turned-off state of the third transistor T3 may be proportional to a drain-source voltage Vds. When the voltage level of the second node N2 varies, the drain-source voltage Vds of the third transistor T3 may increase, and thus, the leakage current due to the third transistor T3 may also increase. If the voltage of the second node N2 may be uniformly maintained at a level similar to the voltage of the first node N1, the leakage current may be reduced.

In an embodiment of the inventive concept, during the emission period, the i-th emission signal ESi is applied through the i-th emission line EL1 to turn on the dummy transistor DMT. The reference voltage Vref1 may be applied to the second node N2 through the dummy transistor DMT that is turned on during the emission period.

The reference voltage Vref1 may have a level higher than the initialization voltage Vint, and may be set to various DC voltages having prescribed levels. For example, the reference voltage Vref1 may be set to an average voltage value of the data voltages provided to the pixels PX. When the data voltages output from the data driver DDV are 2 V to 4 V, the reference voltage Vref1 may be set to the average voltage value of 3 V.

The compensation voltage Vd−Vth applied to the control electrode of the first transistor T1 may correspond to the voltage at the first node N1. The reference voltage Vref1 may be set to the average voltage value of the data voltages, and the voltage of the second node N2 may be similar to the voltage of the first node N1. In this case, the drain-source voltage Vds of the third transistor T3 becomes smaller, and the leakage current due to the third transistor T3 may be reduced.

As discussed above, the reference voltage Vref1 may have the average voltage value of the data voltages according to one embodiment, but the present disclosure is limited thereto. In some embodiments, the data voltage Vd may be provided to the dummy transistor DMT as the reference voltage Vref1. In this case, the first electrode of the dummy transistor DMT may be connected to the i-th data line DLj. In addition, the reference voltage Vref1 may be set to the same voltage as the voltage of the first node N1. For example, the reference voltage Vref1 may be set to the compensation voltage Vd−Vth.

The leakage current of the third transistor T3 may be proportional to a gate-source voltage Vgs. The fourth magnitude ΔV4 of the i-th second control signal GCLi applied to the control electrode of the third transistor T3 may be less than the first, second, and third magnitudes ΔV1, ΔV2, and ΔV3. Accordingly, the gate-source voltage Vgs of the third transistor T3 becomes smaller, and the leakage current due to the third transistor T3 may be further reduced.

Hereinafter, circuit structures of the pixels PX according to various embodiments of the inventive concept will be described with an emphasis on differences from that of the pixel PXij shown in FIG. 3.

Figure 5:
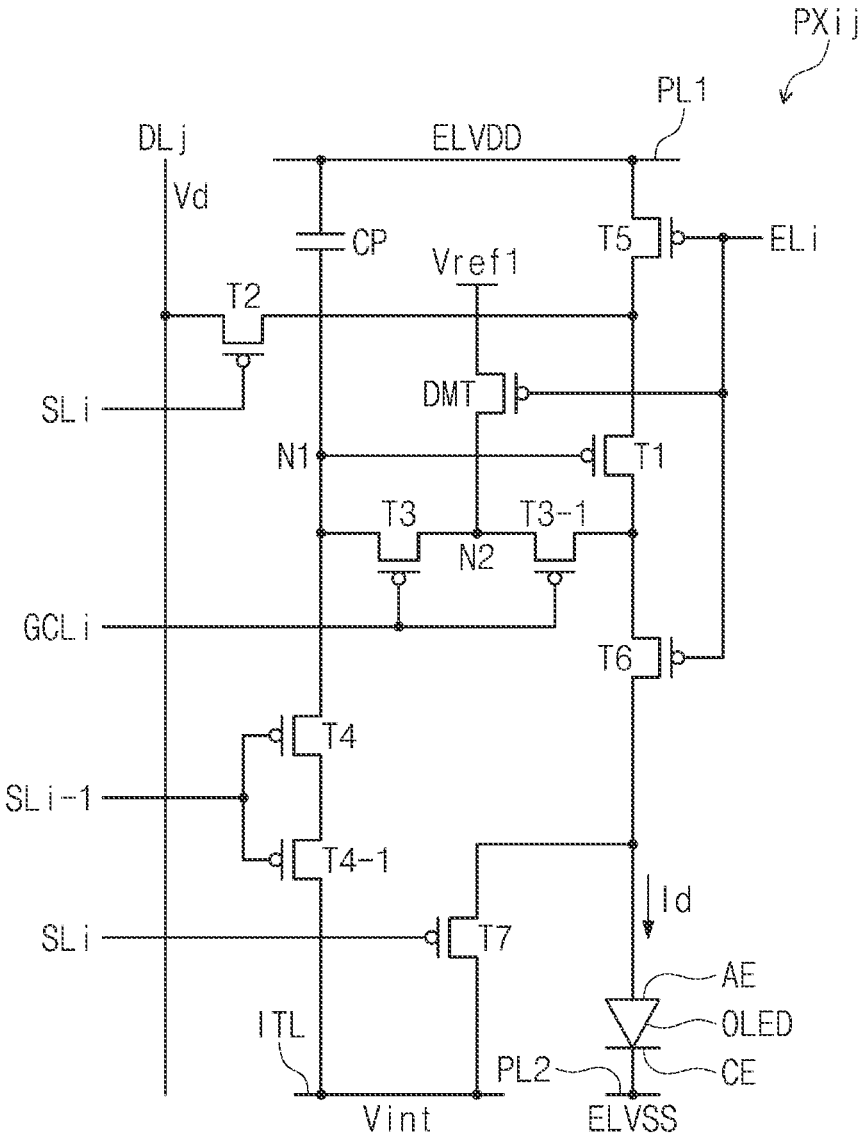
FIG. 5 illustrates an equivalent circuit of a pixel according to another embodiment of the inventive concept.

FIG. 5 illustrates an equivalent circuit of the pixel PXij according to another embodiment of the inventive concept.

Referring to FIG. 5, a connection structure of the transistors of the pixel PX and the capacitor CP may be substantially the same as that of the transistors of the pixel PXij and the capacitor CP shown in FIG. 3. The control electrode of the third transistor T3 and the control electrode of the third-first transistor T3-1 may be commonly connected to the i-th second control line GCLi to receive the i-th second control signal GSLi.

Unlike the structure shown in FIG. 3, in the pixel PXij, the i-th second control signal GSLi may be used as the i-th first control signal applied to the third-first transistor T3-1. In other words, the i-th first control signal applied to the third-first transistor T3-1 may be the same signal as the i-th second control signal GSLi applied to the third transistor T3.

Figure 6:
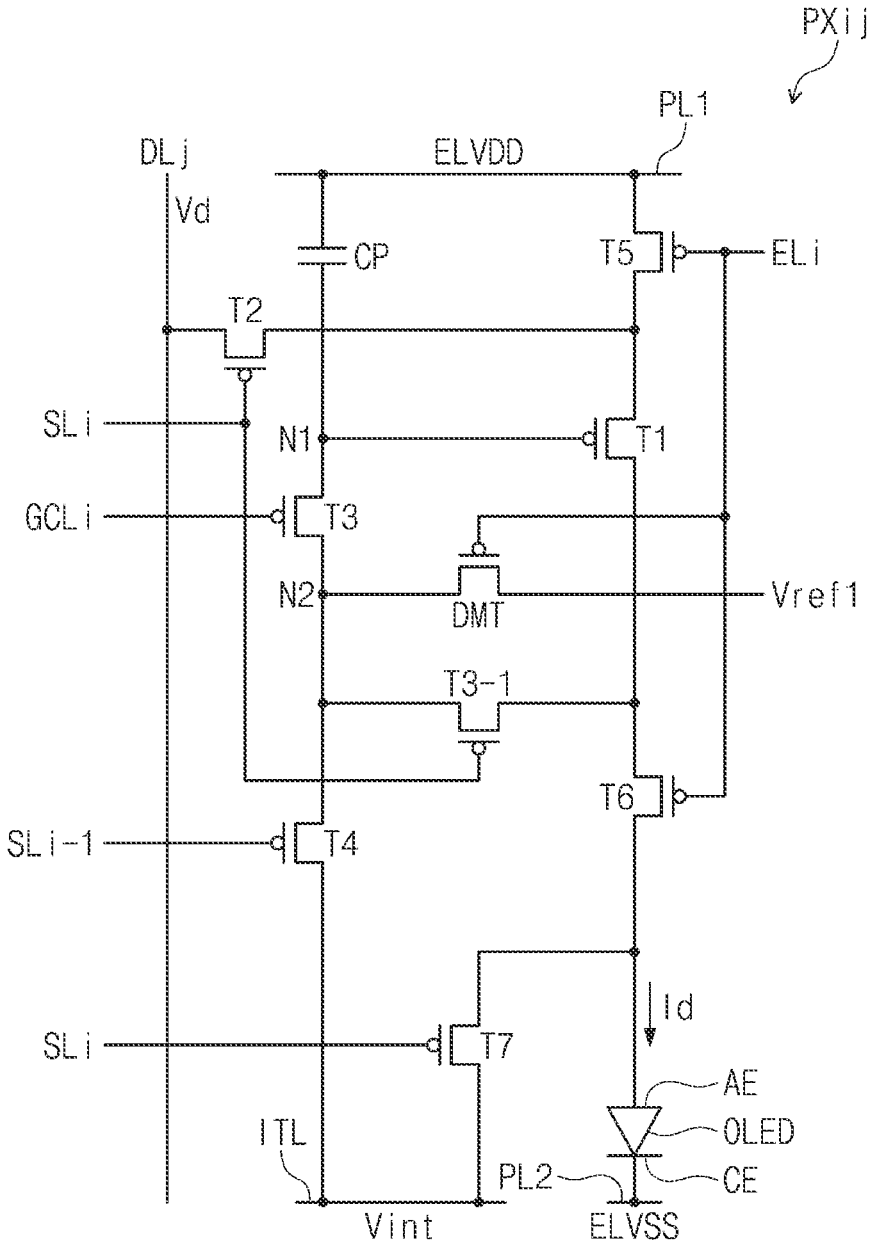
FIG. 6 illustrates an equivalent circuit of a pixel according to another embodiment of the inventive concept.
Figure 7:
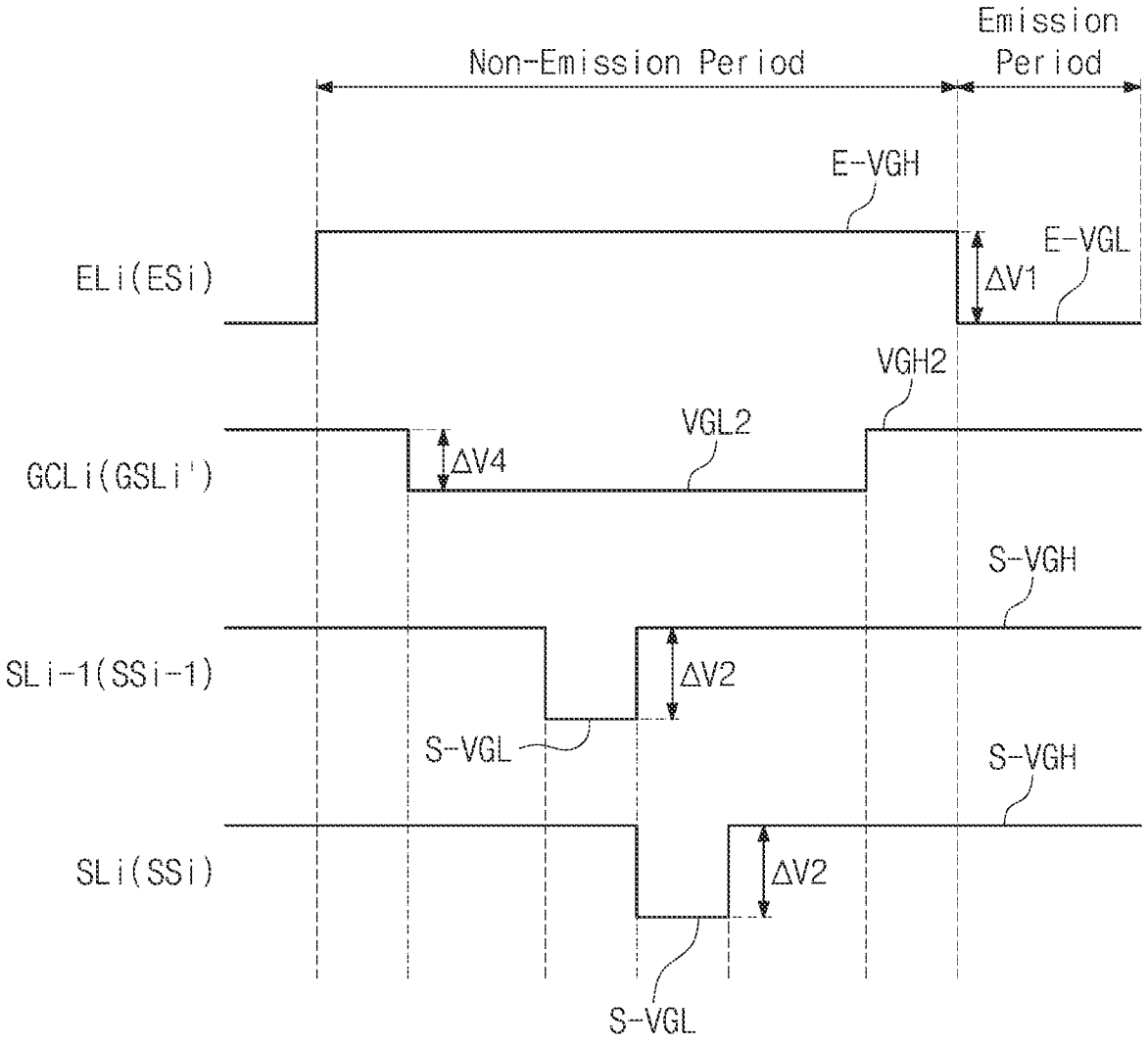
FIG. 7 is a timing diagram of signals for driving the pixel illustrated in FIG. 6.

FIG. 6 illustrates an equivalent circuit of the pixel PXij according to another embodiment of the inventive concept. FIG. 7 is a timing diagram of signals for driving the pixel PXij illustrated in FIG. 6.

Referring to FIG. 6, the fourth transistor T4 of the pixel PXij may include a first electrode connected to the second node N2, a second electrode connected to the initialization line ITL, and a control electrode connected to the (i−1)-th control line SLi−1. In the pixel PXij shown in FIG. 6, other than that the fourth transistor T4 is connected to the second node N2, and the fourth-first transistor T4-1 shown in FIG. 3 is omitted, and the connection structure of other elements may be substantially the same as that shown in FIG. 3.

The control electrode of the third-first transistor T3-1 may be connected to the i-th scan line SLi to receive the i-th scan signal SSi. Unlike the structure shown in FIG. 3, the i-th scan signal SSi may be used as the i-th first control signal applied to the third-first transistor T3-1.

Referring to FIGS. 6 and 7, an i-th second control signal GSLi' may be applied to the third transistor T3 through the i-th second control line GCLi. The i-th second control signal GSLi' may have the fourth magnitude ΔV4 like the i-th second control signal GSLi shown in FIG. 4, but an activation period of the i-th second control signal GSLi' may be longer than that of the i-th second control signal GSLi shown in FIG. 4.

In the non-emission period, the i-th second control signal GSLi' may be activated, and the (i−1)-th scan signal SSi−1 and the i-th scan signal SSi may be activated thereafter. An activation period of the i-th second control signal GSLi' may be longer than the activation period of the (i−1)-th scan signal SSi−1 and the activation period of the i-th scan signal SSi. The activation period of the (i−1)-th scan signal SSi−1 and the activation period of the i-th scan signal SSi may be arranged within the activation period of the i-th second control signal GSLi'. In other words, the (i−1)-th scan signal SSi−1 and the i-th scan signal SSi may be deactivated prior to the deactivation of the i-th second control signal GSLi'.

The third transistor T3 may be turned on by the i-th second control signal GSLi', and the (i−1)-th scan signal SSi−1 may be applied to the fourth transistor T4 to turn on the fourth transistor T4 while the third transistor T3 is turned on. The initialization voltage Vint may be applied to the first node N1 through the third transistor T3 and fourth transistor T4 that are turned on.

The second transistor T2 and the third-first transistor T3-1 may be turned on by the i-th scan signal SSi. The first transistor T1 may be diode-connected through the third-first transistor T3-1 and the third transistor T3 that are turned on. Other operations of the pixel PXij may be substantially the same as those of the pixel PXij shown in FIG. 3, and thus descriptions thereof will be omitted.

Referring to FIG. 3, the third and third-first transistors T3 and T3-1 connected to each other in the pixel PXij may be referred to as a first dual gate structure, and the fourth and fourth-first transistors T4 and T4-1 connected to each other may be referred to as a second dual gate structure.

Referring to FIG. 6, the third and third-first transistors T3 and T3-1 connected to each other in the pixel PXij may be referred to as a first dual gate structure, and the third and fourth transistors T3 and T4 connected to each other may be referred to as a second dual gate structure. In other words, the first dual gate structure and the second dual structure shown in FIG. 6 may be designed by sharing one transistor, i.e., the third transistor T3. Accordingly, the number of transistors to be used in the pixel PXij of FIG. 6 may be reduced compared to the pixel PXij shown in FIG. 3.

Figure 8:
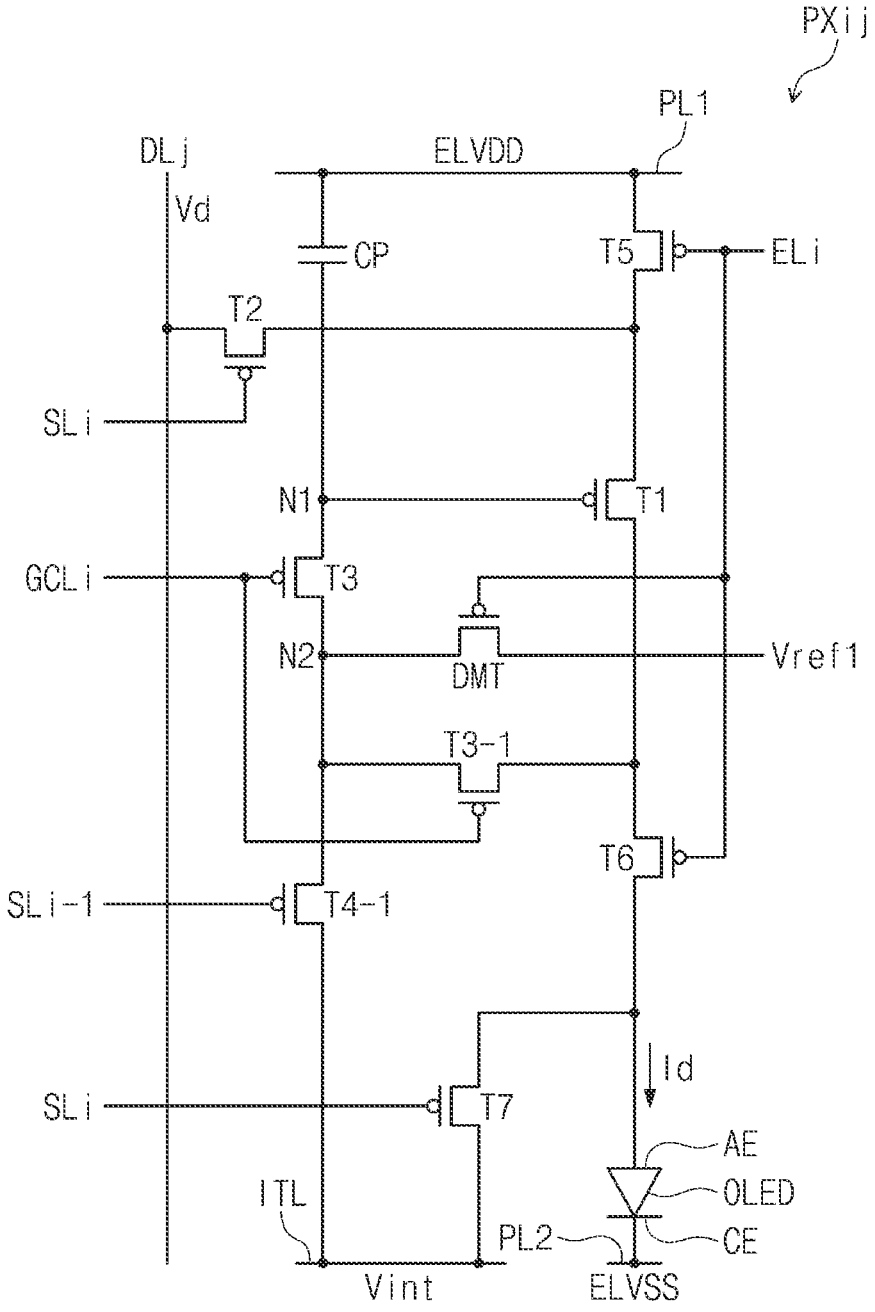
FIG. 8 illustrates an equivalent circuit of a pixel according to another embodiment of the inventive concept.

FIG. 8 illustrates an equivalent circuit of the pixel PXij according to another embodiment of the inventive concept.

Timings of signals to be applied to the pixel PXij shown in FIG. 8 are substantially the same as those in FIG. 7, and thus the operation of the pixel PXij shown in FIG. 8 may be described with reference to the timings of the signals shown in FIG. 7.

Referring to FIGS. 7 and 8, a connection structure of transistors of the pixel PXij and the capacitor CP may be substantially the same as that of the transistors and the capacitor CP of the pixel PXij shown in FIG. 6. The control electrode of the third transistor T3 and the control electrode of the third-first transistor T3-1 may be commonly connected to the i-th second control line GCLi to receive the i-th second control signal GSLi'.

In the pixel PXij shown in FIG. 8, the i-th second control signal GSLi' may be used as the i-th first control signal applied to the third-first transistor T3-1. In other words, the i-th first control signal applied to the third-first transistor T3-1 may be the same signal as the i-th second control signal GSLi'. The third transistor T3 and the third-first transistor T3-1 may be turned on by the i-th second control signal GSLi' received through the i-th second control line GCLi.

Figure 9:
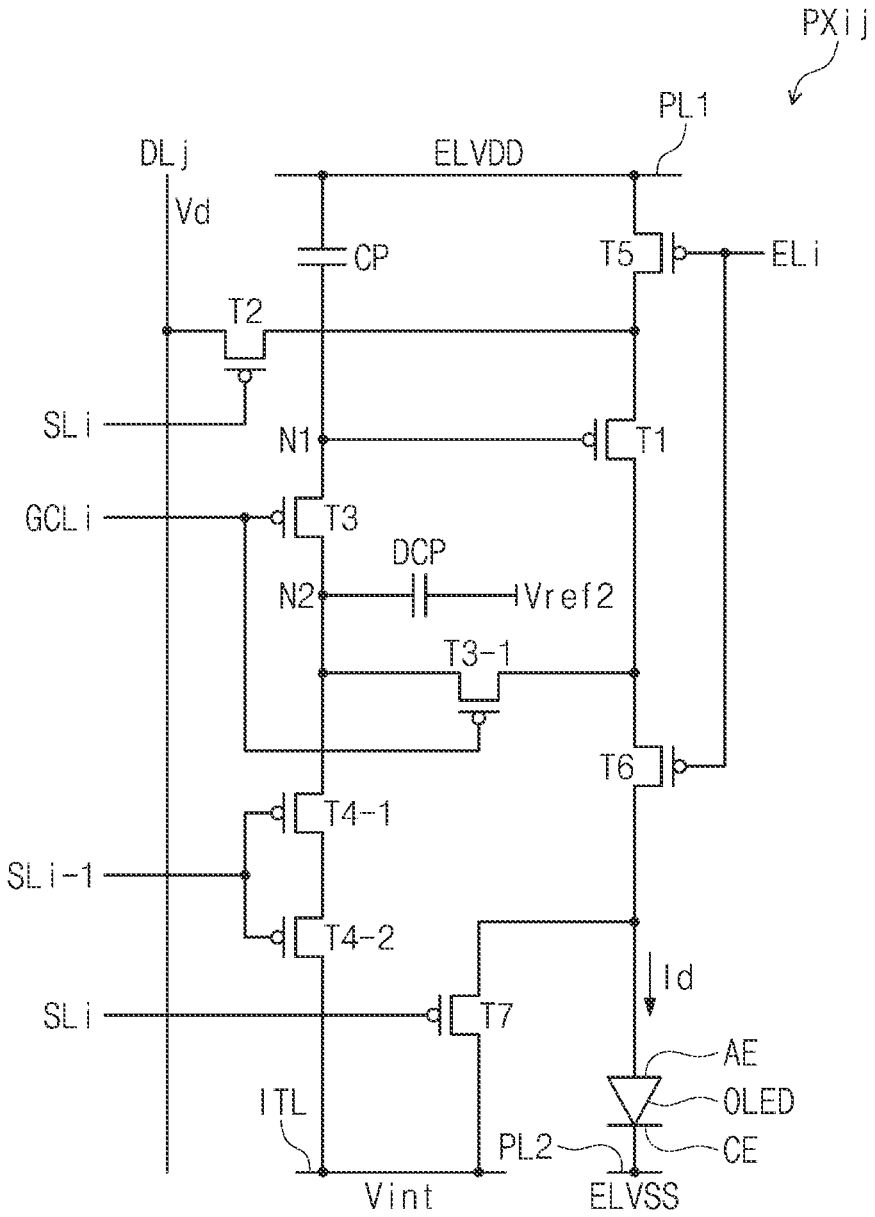
FIG. 9 illustrates an equivalent circuit of a pixel according to another embodiment of the inventive concept.
Figure 10:
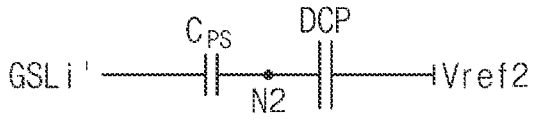
FIG. 10 illustrates a parasitic capacitor and a dummy capacitor illustrated in FIG. 9.

FIG. 9 illustrates an equivalent circuit of the pixel PXij according to another embodiment of the inventive concept. FIG. 10 illustrates a parasitic capacitor and a dummy capacitor illustrated in FIG. 9.

Timings of signals applied to the pixel PXij shown in FIG. 9 are substantially the same as those in FIG. 7, and thus the operation of the pixel PXij shown in FIG. 9 may be described with reference to the timings of the signals shown in FIG. 7.

Referring to FIG. 9, a connection structure of the fourth-first transistor T4-1 and the fourth-second transistor T4-2 of the pixel PXij may be the same as that of the fourth and fourth-first transistors T4 and T4-1 of the pixel PXij shown in FIG. 3. In addition, a connection structure of other transistors T1, T2, T3, T3-1, T5, T6 and T7 and the capacitor CP may be the same as that of the pixel PXij shown in FIG. 6.

In the pixel PXij shown in FIG. 9, the fourth-first transistor T4-1 may be connected to the fourth transistor T4, but the embodiment of the inventive concept is not limited thereto. Like the pixel PXij shown in FIG. 6, the fourth-first transistor T4-1 may be omitted in some embodiments.

The pixel PXij shown in FIG. 9 may further include a dummy capacitor DCP connected to the second node N2. The dummy capacitor DCP may include a first electrode for receiving a reference voltage Vref2, and a second electrode connected to the second node N2. The reference voltage Vref2 may have a level higher than the initialization voltage Vint, and may be set to various DC voltages having prescribed levels.

Referring to FIGS. 9 and 10, a parasitic capacitor Cps may be present in the third transistor T3. The dummy capacitor DCP may have greater capacitance than the parasitic capacitor Cps. The dummy capacitor DCP and the parasitic capacitor Cps may be connected to each other with the second node N2 placed therebetween.

Referring to FIGS. 7, 9, and 10, when the i-th second control line GSLi' is applied to the third transistor T3, a voltage level of the second node N2 may vary due to the parasitic capacitor Cps. However, since the dummy capacitor DCP having greater capacitance is connected to the second node N2, the variation in the voltage level of the second node N2 may be suppressed. The dummy capacitor DCP that has greater capacitance may suppress the voltage level of the second node N2 that may be varied by the parasitic capacitor Cps that has smaller capacitance.

As described in the foregoing, the variation in the voltage level of the second node N2 may be suppressed, and the drain-source voltage Vds of the third transistor T3 may become smaller. Accordingly, the leakage current due to the third transistor T3 may be reduced.

Figure 11:
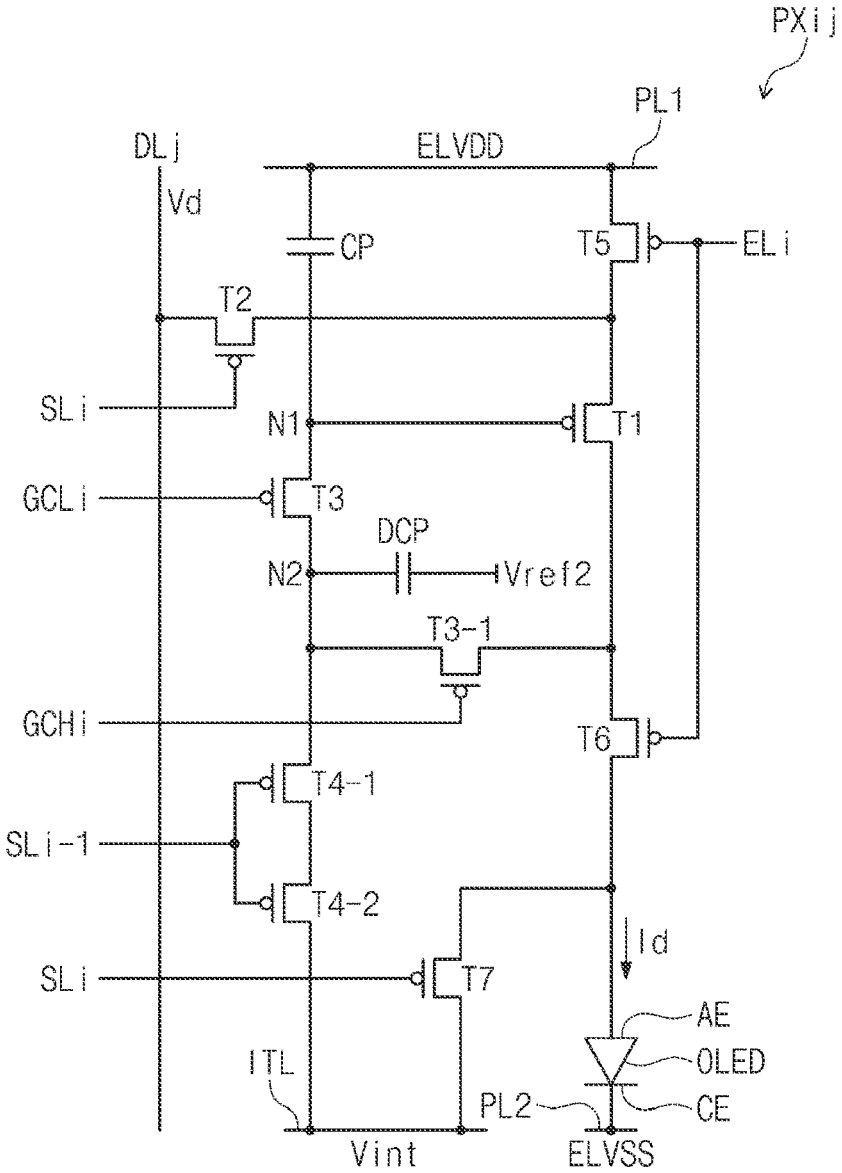
FIG. 11 illustrates an equivalent circuit of a pixel according to another embodiment of the inventive concept.
Figure 12:
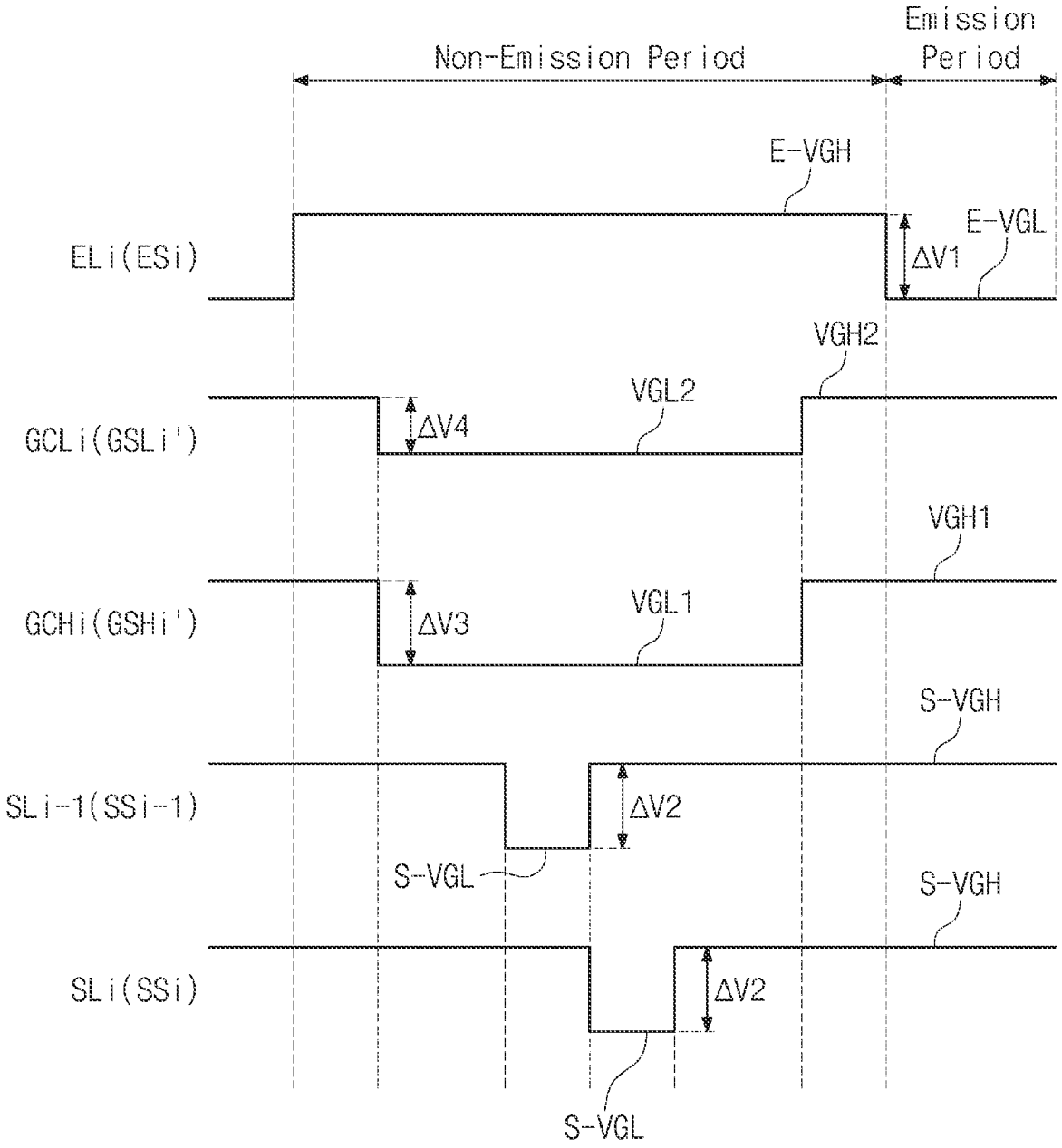
FIG. 12 is a timing diagram of signals for driving the pixel illustrated in FIG. 11.

FIG. 11 illustrates an equivalent circuit of the pixel PXij according to another embodiment of the inventive concept. FIG. 12 is a timing diagram of signals for driving the pixel PXij illustrated in FIG. 11.

Except for an i-th first control signal GSHi' in FIG. 12, timings of other signals shown in FIG. 12 may be identical to those shown in FIG. 7.

Referring to FIGS. 11 and 12, a connection structure of transistors, the capacitor CP, and the dummy capacitor DCP of the pixel PXij may be substantially the same as that of the transistors, the capacitor CP, the dummy capacitor DCP of the pixel PXij shown in FIG. 9.

The control electrode of the third-first transistor T3-1 may be connected to the i-th first control line GCHi to receive the i-th first control signal GSHi'. The control electrode of the third transistor T3 may be connected to the i-th second control line GCLi to receive the i-th second control signal GSLi'.

The i-th first control signal GSHi' may have the third magnitude ΔV3 like the i-th first control signal GSHi shown in FIG. 4. Accordingly, the magnitude of the i-th second control signal GSLi' may be less than that of the i-th first control signal GSHi'. An activation period of the i-th first control signal GSHi' may be longer than that of the i-th first control signal GSHi shown in FIG. 4. The activation period of the i-th first control signal GSHi' may be identical to that of the i-th second control signal GSLi'.

In the non-emission period, the i-th first control signal GSHi' and the i-th second control signal GSLi' may be activated, and the (i−1)-th scan signal SSi−1 and the i-th scan signal SSi may be activated while the i-th first control signal GSHi' and the i-th second control signal GSLi' are activated. The i-th first control signal GSHi' and the i-th second control signal GSLi' may have the same activation timing.

The i-th first control signal GSHi' and the i-th second control signal GSLi' may be respectively applied to turn on the third-first transistor T3-1 and the third transistor T3, and the fourth-first transistor T4-1 and the fourth-second transistor T4-2 may be turned on by the (i−1)-th scan signal SSi−1 thereafter. The initialization voltage Vint may be applied to the first node N1 through the third transistor T3, the fourth-first transistor T4-1 and the fourth-second transistor T4-2 that are turned on.

The i-th scan signal SSi may be applied to turn on the second transistor T2. The first transistor T1 may be diode-connected through the third-first transistor T3-1 and the third transistor T3 that are turned on. Other operations of the pixel PXij are substantially the same as those of the pixel PXij shown in FIG. 3, and thus descriptions thereof will be omitted.

Figure 13:
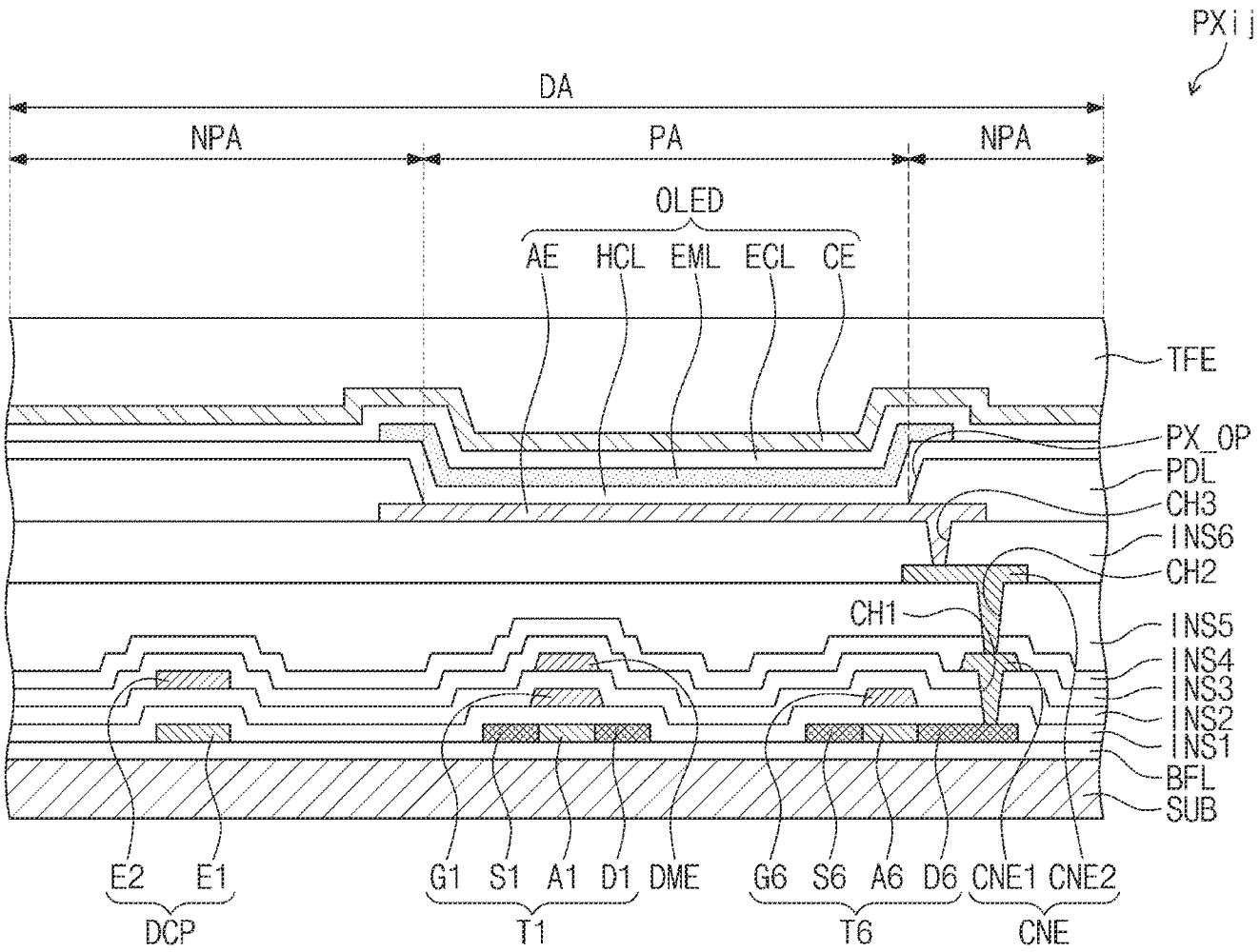
FIG. 13 exemplarily illustrates a cross sectional view of a pixel including a light emitting element, a first transistor, and a sixth transistor that are illustrated in FIG. 3.

FIG. 13 exemplarily illustrates a cross sectional view of the pixel PXij including the light emitting element OLED, the first transistor T1, and the sixth transistor T6 that are illustrated in FIG. 3.

Referring to FIG. 13, the light emitting element OLED may include a first electrode (herein also referred to as the anode AE), a second electrode (herein also referred to as the cathode CE 3), a hole control layer HCL, an electron control layer ECL, and a light emitting layer EML.

The first transistor T1, the sixth transistor T6, and the light emitting element OLED may be arranged on a substrate SUB. The display area DA corresponding to the pixel PXij may include a light emitting area PA and non-light emitting areas NPA around the light emitting area PA. The light emitting element OLED may be arranged in the light emitting area PA of the pixel PXij.

A buffer layer BFL may be arranged on the substrate SUB. The buffer layer BFL may include an inorganic layer. A semiconductor pattern may be arranged on the buffer layer BFL. The semiconductor pattern may include polysilicon. However, the embodiment of the present disclosure is not limited thereto, and the semiconductor pattern may include amorphous silicon or metal oxides.

The electrical property of the semiconductor pattern may vary based on a type of a doping material. The semiconductor pattern may include a doped area and a non-doped area. The doped area may be doped with an N-type dopant or a P-type dopant. The conductivity of the doped area may be greater than that of the non-doped area, and the doped area may substantially play roles of a source electrode and a drain electrode of a transistor. The non-doped area may substantially correspond to an active area (or a channel) of the transistor.

A source electrode Si, an active area A1, and a drain electrode D1 of the first transistor T1, and a source electrode S6, an active area A6, and a drain electrode D6 of the sixth transistor T6 may be formed from the semiconductor pattern. A first insulation layer INS1 may be arranged on the semiconductor pattern. A gate electrode (or a control electrodes) G1 of the transistor T1 and a gate electrode G6 of the sixth transistor T6 may be arranged on the first insulation layer INS1.

A second insulation layer INS2 may be arranged on the gate electrodes G1 and G6. A dummy electrode DME may be arranged on the second insulation layer INS2. The dummy electrode DME may be arranged in an upper layer than the first and sixth transistor T1 and T6. A third insulation layer INS3 may be arranged on the dummy electrode DME.

A connection electrode CNE may be arranged between the sixth transistor T6 and the light emitting element OLED. The connection electrode CNE may connect the sixth transistor T6 and the light emitting element OLED. The connection electrode CNE may include a first connection electrode CNE1 and a second connection electrode CNE2 that is arranged on the first connection electrode CNE1. The first connection electrode CNE1 may be arranged on the sixth transistor T6 to be connected to the sixth transistor T6. The second connection electrode CNE2 may be arranged between the first connection electrode CNE1 and the first electrode AE of the light emitting element OLED to connect them.

The first connection electrode CNE1 may be arranged on the third insulation layer INS3, and may be connected to the drain electrode D6 through a first contact hole CH1 that may penetrate through the first to third insulation layers INS1 to INS3. A fourth insulation layer INS4 may be arranged on the first connection electrode CNE1. A fifth insulation layer INS5 may be arranged on the fourth insulation layer INS4. The second connection electrode CNE2 may be disposed on the fifth insulation layer INS5. The second connection electrode CNE2 may be connected to the first connection electrode CNE1 through a second contact hole CH2 that penetrates through the fifth insulation layer INS5.

A sixth insulation layer INS6 may be arranged on the second connection electrode CNE2. The layers from the buffer layer BFL to the sixth insulation layers INS6 may be collectively referred to as a circuit element layer DP-CL. The first insulation layer INS1 to the sixth insulation layer INS6 may include inorganic layers and/or organic layers.

The first electrode AE of the light emitting element OLED may be disposed on the sixth insulation layer INS6. The first electrode AE may be connected to the second connection electrode CNE2 through a third contact hole CH3 that penetrates through the sixth insulation layer INS6. A pixel definition layer PDL for exposing a portion of the first electrode AE may be arranged on the first electrode AE and the sixth insulation layer INS6. In the pixel definition layer PDL, an opening part PX_OP may expose the portion of the first electrode AE of the light emitting element OLED.

The hole control layer HCL may be arranged on the first electrode AE and the pixel definition layer PDL. The hole control layer HCL may be commonly arranged in the light emitting area PA and the non-light emitting area NPA. The hole control layer HCL may include a hole transport layer and/or a hole injection layer.

The light emitting layer EML may be arranged on the hole control layer HCL. The light emitting layer EML may be arranged in an area corresponding to the opening part PX_OP. The light emitting layer EML may include an organic material and/or inorganic material. The light emitting layer EML may generate light of one of red, green, and blue colors.

The electron control layer ECL may be arrange on the light emitting layer EML and the hole control layer HCL. The electron control layer ECL may be commonly arranged in the light emitting area PA and the non-light emitting area NPA. The electron control layer ECL may include an electron transport layer and/or an electron injection layer.

The second electrode CE may be arranged on the electron control layer ECL. The second electrode CE may be commonly arranged in the plurality of pixels PX. A thin film encapsulation layer TFE may be arranged on the light emitting element OLED.

The first voltage ELVDD may be applied to the first electrode AE, and the second voltage ELVSS may be applied to the second electrode CE. A hole and an electron injected to the light emitting layer EML may be combined to form an exciton, and the light emitting element OLED may emit light while the exciton is transitioned to the ground state. The light emitting element OLED may emit light to display an image.

The dummy capacitor DCP may be arranged on the substrate SUB. A first electrode E1 of the dummy capacitor DCP may be formed of the same material as the active areas A1 and A6 and may be arranged in the same layer as the active areas A1 and A6. A second electrode E2 of the dummy capacitor DCP may be formed of the same material as the dummy electrode DME and may be arranged in the same layer as the dummy electrode DME.

FIGS. 14 to 18 exemplarily illustrate cross-sectional views of the pixel PXij according to various embodiments of the inventive concept.

FIGS. 14 to 18 are exemplarily illustrated as cross sections of the PXij corresponding to FIG. 13. The configurations of the light emitting element OLED shown in FIGS. 14 to 18 and the first to sixth transistors T1 and T6 may be substantially the same as those in FIG. 13, and configurations of the dummy capacitors DCP_1 to DCP_5 will be described hereinafter.

Figure 14:
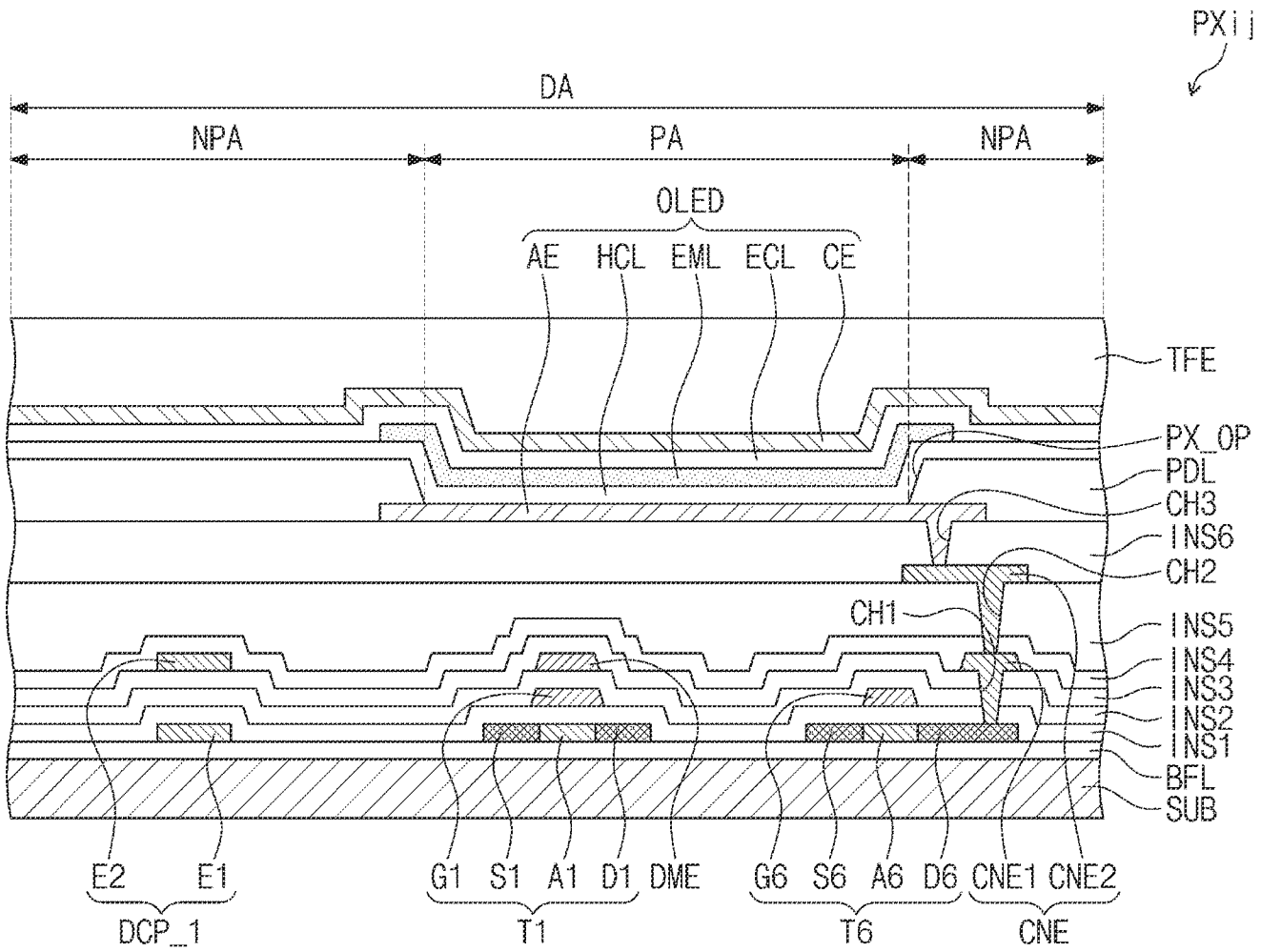
FIG. 14, FIG. 15, FIG. 16, FIG. 17, and FIG. 18 exemplarily illustrate cross-sectional views of a pixel according to various embodiments of the inventive concept.

Referring to FIG. 14, the first electrode E1 of the dummy capacitor DCP_1 may be formed of the same material as the active areas A1 and A6 and may be arranged in the same layer as the active areas A1 and A6. The second electrode E2 of the dummy capacitor DCP_1 may be formed of the same material as the first connection electrode CNE1 and may be arranged in the same layer as the first connection electrode CNE1.

Figure 15:
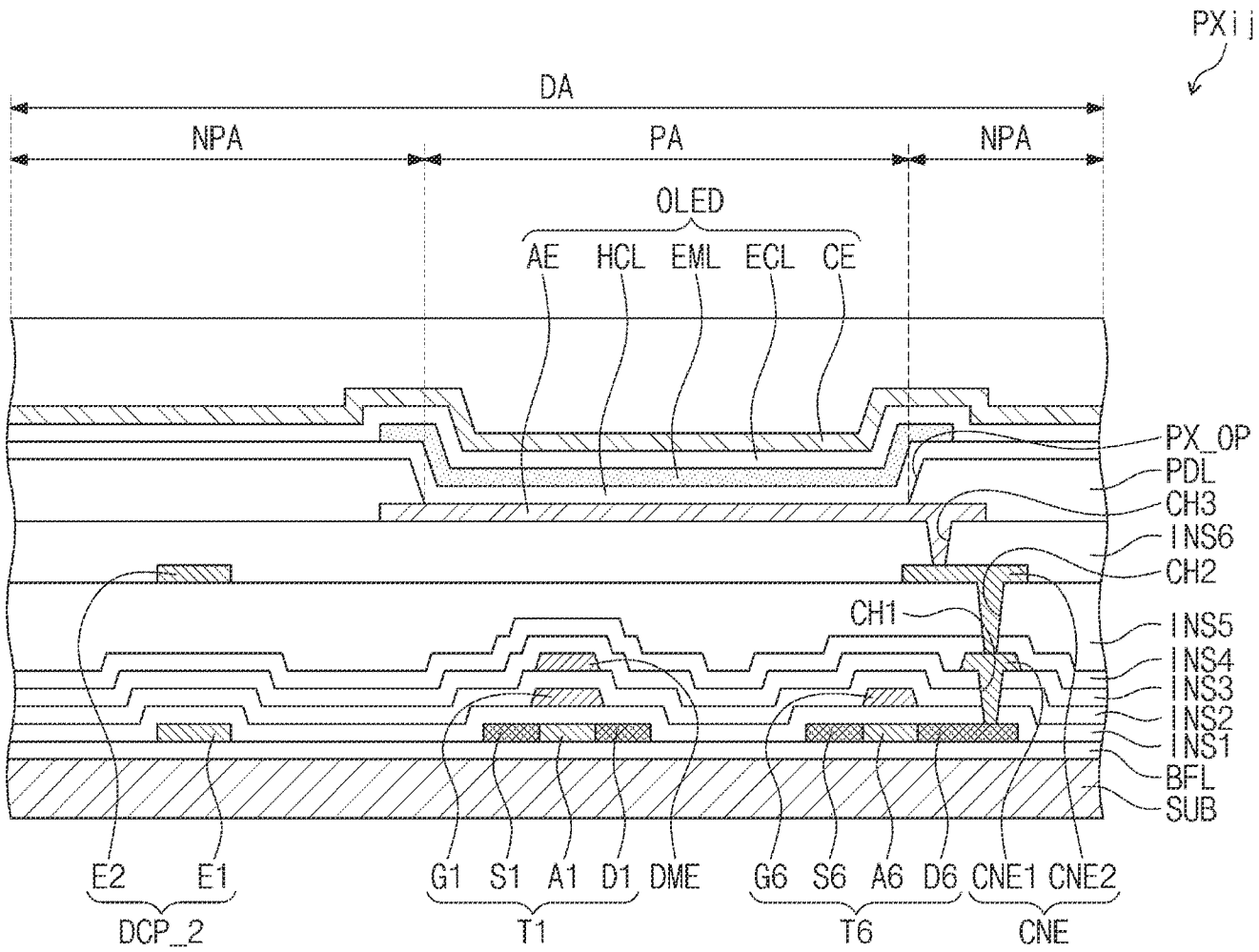

Referring to FIG. 15, the first electrode E1 of the dummy capacitor DCP_2 may be formed of the same material as the active areas A1 and A6 and may be arranged in the same layer as the active areas A1 and A6. The second electrode E2 of the dummy capacitor DCP_2 may be formed of the same material as the second connection electrode CNE2 and may be arranged in the same layer as the second connection electrode CNE2.

Figure 16:
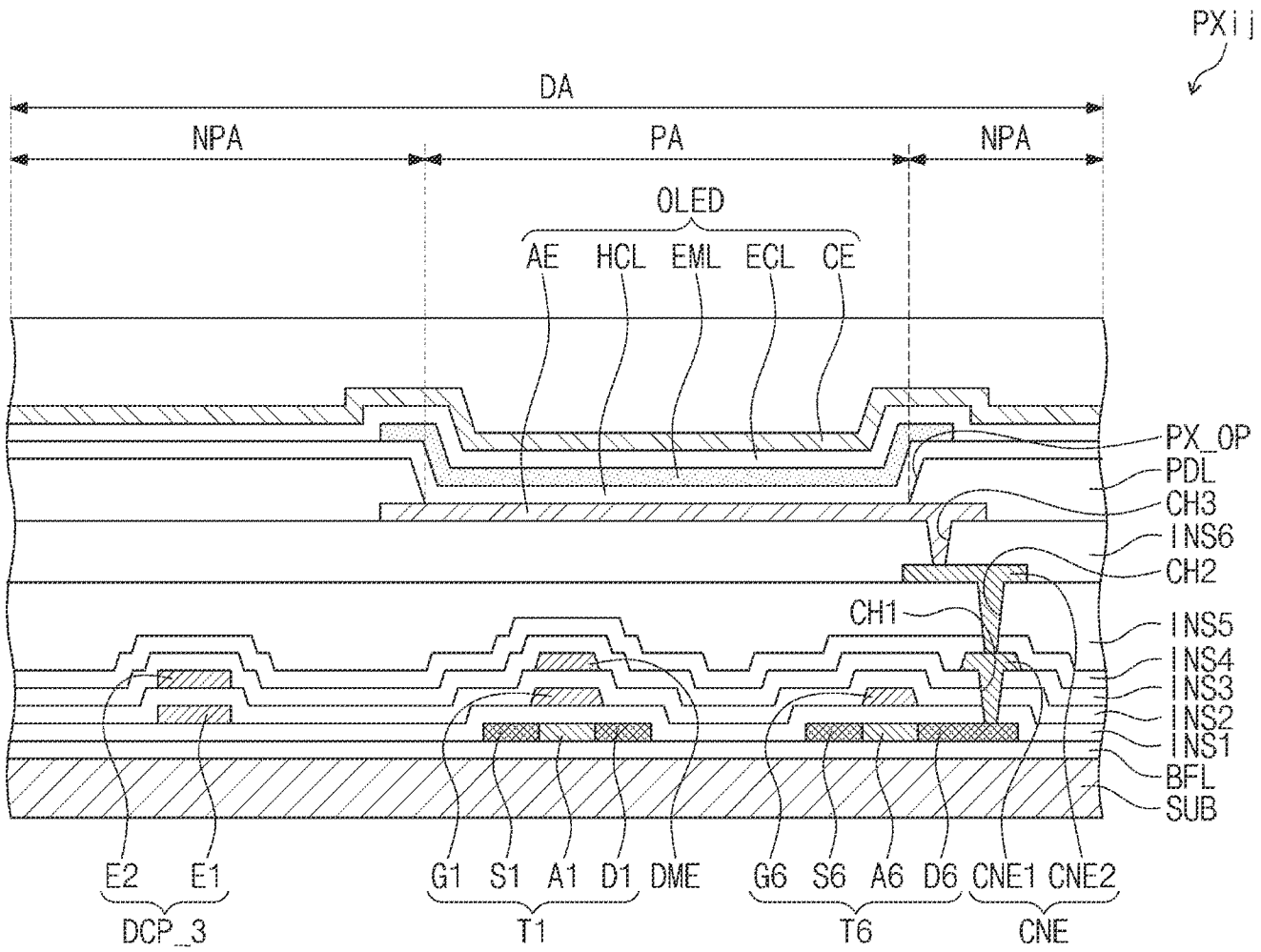

Referring to FIG. 16, the first electrode E1 of the dummy capacitor DCP_3 may be formed of the same material as the gate electrodes G1 and G6 and may be arranged in the same layer as the gate electrodes G1 and G6. The second electrode E2 of the dummy capacitor DCP_3 may be formed of the same material as the dummy electrode DME and may be arranged in the same layer as the dummy electrode DME.

Figure 17:
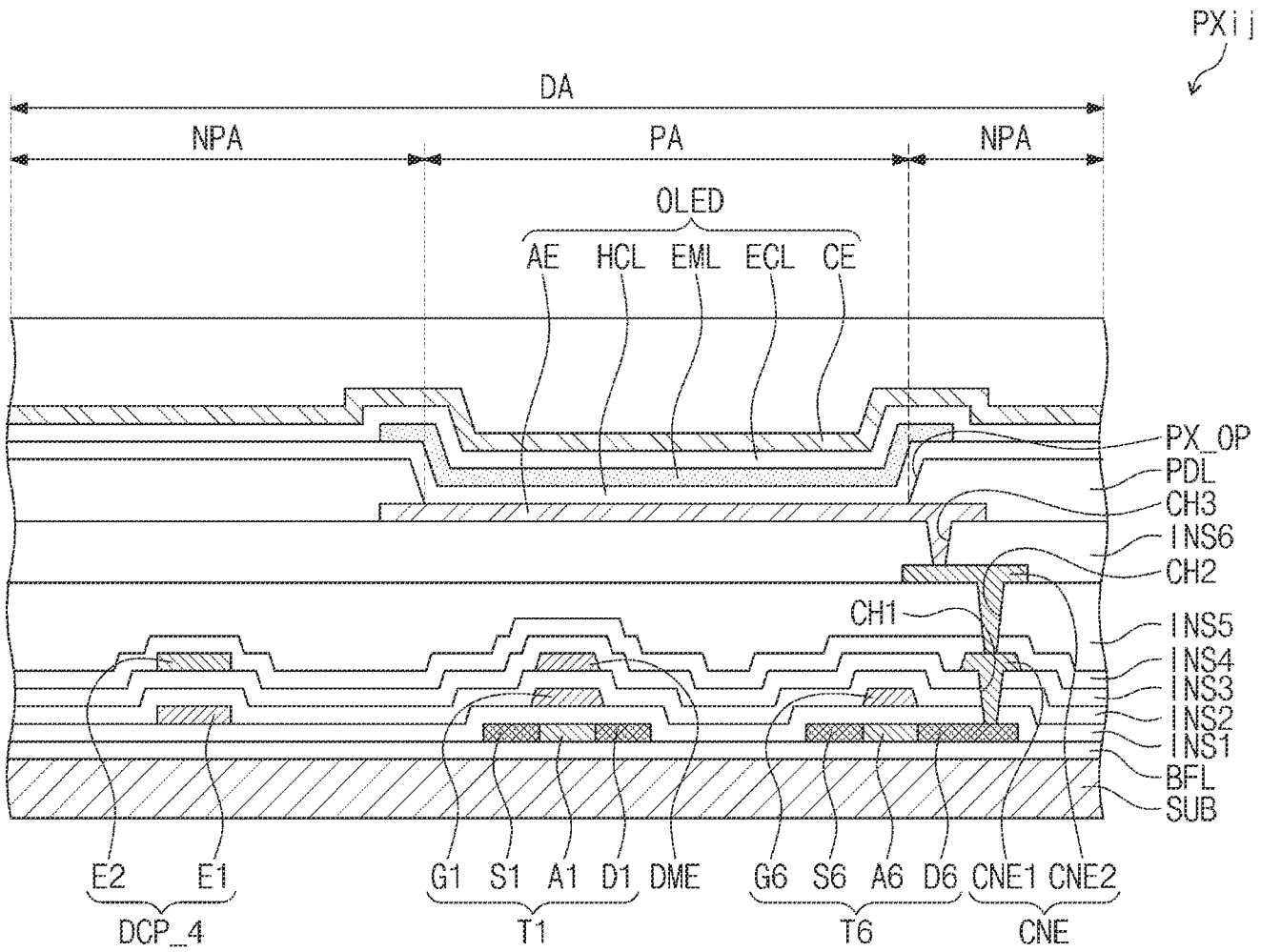

Referring to FIG. 17, the first electrode E1 of the dummy capacitor DCP_4 may be formed of the same material as the gate electrodes G1 and G6 and may be arranged in the same layer as the gate electrodes G1 and G6. The second electrode E2 of the dummy capacitor DCP_4 may be formed of the same material as the first connection electrode CNE1 and may be arranged in the same layer as the first connection electrode CNE1.

Figure 18:
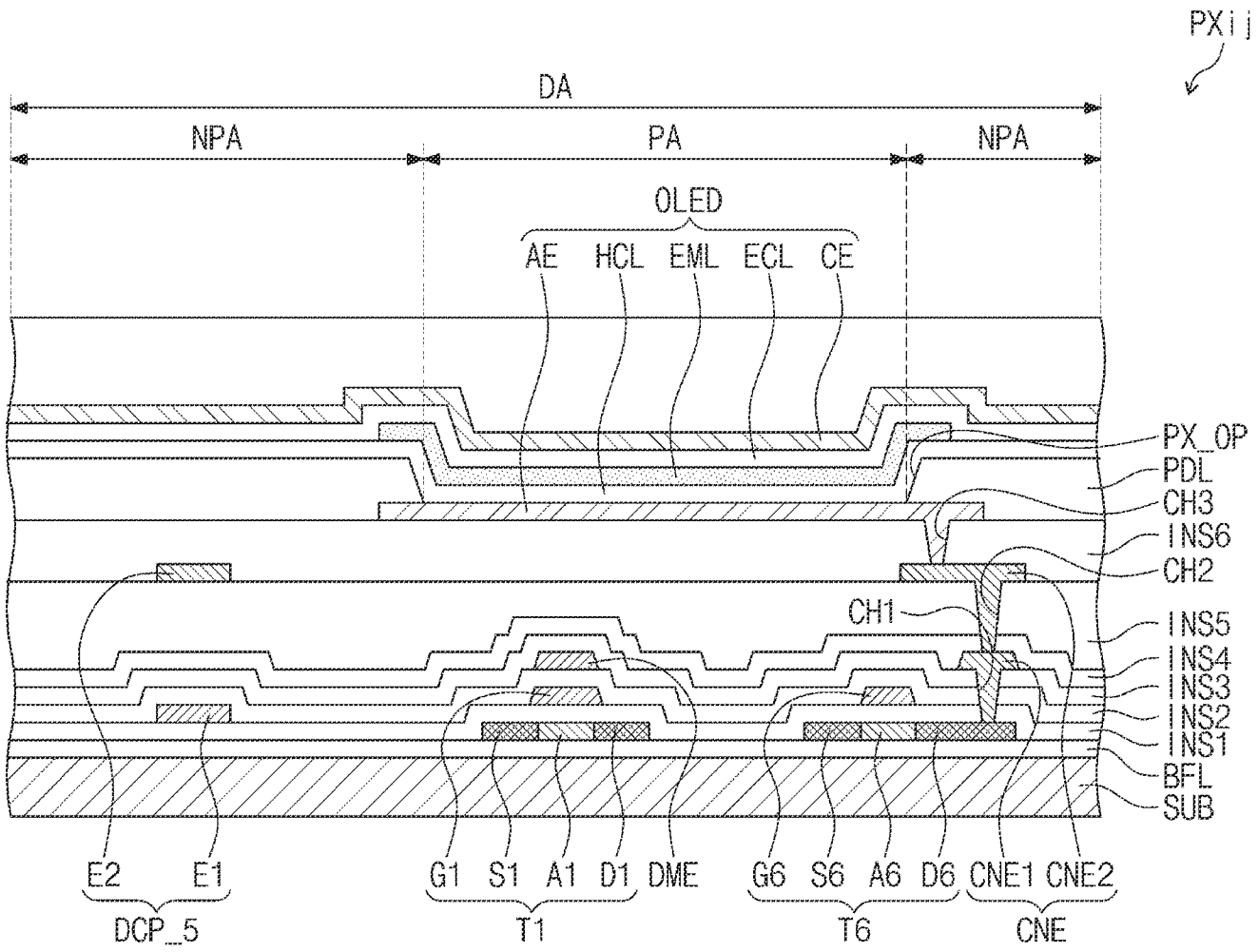

Referring to FIG. 18, the first electrode E1 of the dummy capacitor DCP_5 may be formed of the same material as the gate electrodes G1 and G6 and may be arranged in the same layer as the gate electrodes G1 and G6. The second electrode E2 of the dummy capacitor DCP_5 may be formed of the same material as the second connection electrode CNE2 and may be arranged in the same layer as the second connection electrode CNE2.

According to the embodiment of the inventive concept, a DC level reference voltage (e.g., the reference voltage Vref1) may be applied to a node (e.g., the second node N2) between the third transistor T3 and the third-first transistor T3-1 to reduce the leakage current.

Although the embodiments of the present disclosure have been described, it is understood that the present disclosure should not be limited to these embodiments but various changes and modifications can be made by one ordinary skilled in the art within the spirit and scope of the present disclosure. In addition, the embodiments disclosed in the present disclosure are not intended to limit the technical spirit of the inventive concept, and the scope of the present disclosure should be interpreted based on the entirety of the disclosure including appended claims and it should be appreciated that all technical spirits included within a range equivalent thereto are included in the scope of the present disclosure.

What is claimed is:

1. A display device comprising:

a pixel, wherein the pixel comprises:

a light emitting element;

a first transistor comprising a first electrode connected to a first power line, a second electrode connected to the light emitting element, and a control electrode connected to a first node;

a second transistor comprising a first electrode connected to a data line, a second electrode connected to the first electrode of the first transistor, and a control electrode connected to an i-th scan line, wherein i is a natural number;

a third-first transistor comprising a first electrode connected to the second electrode of the first transistor, a second electrode connected to a second node, and a control electrode receiving a first control signal;

a third transistor comprising a first electrode connected to the second node, a second electrode connected to the first node, and a control electrode receiving a second control signal; and a dummy transistor comprising a first electrode receiving a reference voltage, a second electrode connected to the second node, and a control electrode connected to an emission line, wherein the i-th scan line provides an i-th scan signal to the control electrode of the second transistor, and wherein a magnitude of the second control signal is less than a magnitude of the i-th scan signal.

2. The display device of claim 1, wherein the reference voltage is set to an average voltage value of data voltages provided to a plurality of pixels.

3. The display device of claim 1, wherein the reference voltage corresponds to a value obtained by subtracting a threshold voltage of the first transistor from a data voltage applied to the data line.

4. The display device of claim 1, wherein the reference voltage is set to a data voltage applied to the data line.

5. The display device of claim 1, wherein a second magnitude of the second control signal that corresponds to a second difference between a second high level of the second control signal and a second low level of the second control signal is less than a first magnitude of the first control signal that corresponds to a first difference between a first high level of the first control signal and a first low level of the first control signal.

6. The display device of claim 1, wherein a second magnitude of the second control signal that corresponds to a second difference between a second high level of the second control signal and a second low level of the second control signal is less than a first magnitude of an emission signal applied to the emission line and a third magnitude of the i-th scan signal applied to the i-th scan line, and the first magnitude of the emission signal corresponds to a first difference between a first high level of the emission signal and a first low level of the emission signal, and the third magnitude of the i-th scan signal corresponds to a third difference between a third high level of the i-th scan signal and a third low level of the i-th scan signal.

7. The display device of claim 1, wherein the first control signal and the second control signal have a same timing as the i-th scan signal applied to the i-th scan line.

8. The display device of claim 1, further comprising:

a fourth transistor comprising a first electrode connected to the first node, a second electrode receiving an initialization voltage, and a control electrode connected to an (i−1)-th scan line;

a fifth transistor comprising a first electrode connected to the first power line, a second electrode connected to the first electrode of the first transistor, and a control electrode connected to the emission line; and a sixth transistor comprising a first electrode connected to the second electrode of the first transistor, a second electrode connected to the light emitting element, and a control electrode connected to the emission line.

9. The display device of claim 8, wherein the first control signal is same as the second control signal.

10. The display device of claim 1, further comprising:

a fourth transistor comprising a first electrode connected to the second node, a second electrode receiving an initialization voltage, and a control electrode connected to an (i−1)-th scan line;

a fifth transistor comprising a first electrode connected to the first power line, a second electrode connected to the first electrode of the first transistor, and a control electrode connected to the emission line; and a sixth transistor comprising a first electrode connected to the second electrode of the first transistor, a second electrode connected to the light emitting element, and a control electrode connected to the emission line.

11. The display device of claim 10, wherein the first control signal and the second control signal have a same voltage magnitude.

12. The display device of claim 10, wherein the first control signal is same as the second control signal.

13. The display device of claim 10, wherein a first activation period of the second control signal is longer than a second activation period of an (i−1)-th scan line applied to the (i−1)-th scan line and a third activation period of the i-th scan signal applied to the i-th scan line, and the third activation period of the i-th scan signal and the second activation period of the (i−1)-th scan signal are disposed within the first activation period of the second control signal.

14. A display device comprising:

a pixel, wherein the pixel comprises:

a light emitting element;

a first transistor comprising a first electrode connected to a first power line, a second electrode connected to the light emitting element, and a control electrode connected to a first node;

a second transistor comprising a first electrode connected to a data line, a second electrode connected to the first electrode of the first transistor, and a control electrode connected to an i-th scan line, wherein i is a natural number;

a third-first transistor comprising a first electrode connected to the second electrode of the first transistor, a second electrode connected to a second node, and a control electrode receiving a control signal that;

a third transistor comprising a first electrode connected to the second node, a second electrode connected to the first node, and a control electrode receiving the control signal; and a dummy capacitor comprising a first electrode receiving a reference voltage, and a second electrode connected to the second node;

wherein the i-th scan line provides an i-th scan signal to the control electrode of the second transistor, and wherein a magnitude of the control signal is less than a magnitude of the i-th scan signal.

15. The display device of claim 14, further comprising:

a fourth transistor comprising a first electrode connected to the second node, a second electrode receiving an initialization voltage, and a control electrode connected to an (i−1)-th scan line;

a fifth transistor comprising a first electrode connected to the first power line, a second electrode connected to the first electrode of the first transistor, and a control electrode connected to an emission line; and a sixth transistor comprising a first electrode connected to the second electrode of the first transistor, a second electrode connected to the light emitting element, and a control electrode connected to the emission line.

16. The display device of claim 15, wherein a first activation period of the control signal is longer than a second activation period of an (i−1)-th scan signal applied to the (i−1)-th scan line and a third activation period of the i-th scan signal applied to the (i−1)-th scan line, and the third activation period of the i-th scan signal and the second activation period of the (i−1)-th scan signal are disposed within the first activation period of the control signal.

17. The display device of claim 16, wherein the control signal comprises:

a first control signal applied to the control electrode of the third-first transistor; and a second control signal applied to the control electrode of the third transistor, wherein a second magnitude of the second control signal that corresponds to a second difference between a second high level of the second control signal and a second low level of the second control signal is less than a first magnitude of the first control signal that corresponds to a first difference between a first high level of the first control signal and a first low level of the first control signal.

18. The display device of claim 15, further comprising:

a first connection electrode disposed on the sixth transistor and connected to the sixth transistor;

a second connection electrode disposed on the first connection electrode and connected to the first connection electrode and the light emitting element; and a dummy electrode disposed in an upper layer than the first transistor.

19. The display device of claim 18, wherein the first electrode of the dummy capacitor is formed of a same material as an active area of the first transistor and disposed in a same layer as the active area of the first transistor, and the second electrode of the dummy capacitor is formed of a same material as one among the dummy electrode, the first connection electrode, and the second connection electrode and disposed in a same layer as the one among the dummy electrode, the first connection electrode, and the second connection electrode.

20. The display device of claim 18, wherein the first electrode of the dummy capacitor is formed of a same material as the control electrode of the first transistor and disposed in a same layer as the control electrode of the first transistor, and the second electrode of the dummy capacitor is formed of a same material as one of the dummy electrode, the first connection electrode, or the second connection electrode and disposed in a same layer as the one of the dummy electrode, the first connection electrode, or the second connection electrode.

* * * * *